US010407930B2

(12) United States Patent
Renaud et al.

(10) Patent No.: US 10,407,930 B2
(45) Date of Patent: Sep. 10, 2019

(54) AUTOMATIC ELECTRIC TOP BOTTOM SWIMMING POOL CLEANER WITH INTERNAL PUMPS

(71) Applicant: Hayward Industries, Inc., Elizabeth, NJ (US)

(72) Inventors: Benoit Joseph Renaud, Fort Atkinson, WI (US); David John Hardy, Walkertown, NC (US)

(73) Assignee: Hayward Industries, Inc., Elizabeth, NJ (US)

( * ) Notice: Subject to any disclaimer, the term of this patent is extended or adjusted under 35 U.S.C. 154(b) by 1215 days.

(21) Appl. No.: 14/212,516

(22) Filed: Mar. 14, 2014

(65) Prior Publication Data

US 2014/0262997 A1 Sep. 18, 2014

Related U.S. Application Data

(60) Provisional application No. 61/792,333, filed on Mar. 15, 2013.

(51) Int. Cl.
*E04H 4/16* (2006.01)
*F04D 29/18* (2006.01)

(52) U.S. Cl.
CPC ..... *E04H 4/1654* (2013.01); *E04H 4/1663* (2013.01)

(58) Field of Classification Search
CPC ..... E04H 4/1654; E04H 4/1663; E04H 4/16; F04D 29/18
USPC ..... 210/138, 141, 167.2
See application file for complete search history.

(56) References Cited

U.S. PATENT DOCUMENTS

| | | | | |
|---|---|---|---|---|
| 3,412,862 | A | 11/1968 | Chaplin | |
| 5,852,984 | A * | 12/1998 | Matsuyama | G21C 17/01 114/222 |
| 5,933,899 | A | 8/1999 | Campbell et al. | |
| 5,985,156 | A | 11/1999 | Henkin et al. | |
| 6,039,886 | A | 3/2000 | Henkin et al. | |
| 2006/0065580 | A1 * | 3/2006 | Henkin | E04H 4/1654 210/97 |

(Continued)

FOREIGN PATENT DOCUMENTS

| | | | | |
|---|---|---|---|---|
| EP | 1022411 | A2 | 7/2000 | |
| WO | 97/49504 | A1 | 12/1997 | |
| WO | WO 2012/108903 | * | 8/2012 | E04H 4/16 |

OTHER PUBLICATIONS

WO 2012/108903 attached.*

(Continued)

*Primary Examiner* — Robert Clemente
*Assistant Examiner* — Akash K Varma
(74) *Attorney, Agent, or Firm* — McCarter & English, LLP

(57) ABSTRACT

The present disclosure relates to an electric top bottom cleaner for pools or spas that includes internal pumps for suction and propulsion purposes. The pool cleaner includes a housing having a front end, a rear end, a first side, a second side, a bottom wall, and a top wall, with a first aperture extending through the bottom wall and a second aperture extending through the top wall. A tube extends through the housing between the first aperture and the second aperture. A debris retention mechanism is connectable to the housing. A first pump, a second pump, and a third pump are positioned within the housing.

37 Claims, 18 Drawing Sheets

(56) References Cited

U.S. PATENT DOCUMENTS

2008/0235887 A1* 10/2008 Horvath ..... E04H 4/1654
15/1.7

OTHER PUBLICATIONS

International Search Report of the International Searching Authority dated Jul. 28, 2014, issued in connection with International Application No. PCT/US2014/028359 (2 pages).
Written Opinion dated Jul. 28, 2014, issued in connection with International Application No. PCT/US2014/028359 (15 pages).
Extended European Search Report dated Oct. 24, 2016, issued by the European Patent Office in connection with European Patent Application No. 14763468.7 (8 pages).
Extended European Search Report dated Jul. 30, 2018 issued by the European Patent Office in connection with European Patent Application No. 18176050.5 (8 pages).

* cited by examiner

AUTOMATIC ELECTRIC TOP BOTTOM SWIMMING POOL CLEANER WITH INTERNAL PUMPS

CROSS-REFERENCE TO RELATED APPLICATIONS

The present application claims the priority of U.S. Provisional Application Ser. No. 61/792,333 filed Mar. 15, 2013, the disclosure of which is expressly incorporated herein by reference in its entirety.

BACKGROUND

Technical Field

The present disclosure relates to apparatus for cleaning a swimming pool, and, more specifically, to an automatic electric top bottom swimming pool cleaner with internal pumps.

Related Art

Swimming pools generally require a certain amount of maintenance. Beyond the treatment and filtration of pool water, the walls of the pool should be scrubbed regularly. Further, leaves and various debris can float on the surface of the pool water, which should be removed regularly. This means that a pool cleaner should be capable of cleaning both the walls of the pool as well as the surface of the pool water. Alternatively, two separate cleaning apparatus would be required, or conventional means of handheld cleaning must be employed.

Swimming pool cleaners adapted to rise proximate a water surface of a pool for removing floating debris therefrom and to descend proximate to a wall surface of the pool for removing debris therefrom are known in the art. These "top-bottom" cleaners are often pressure-type or positive pressure pool cleaners that require a source of pressurized water to be in communication therewith. This source of pressurized water could include a booster pump or pool filtration system. Generally, this requires a hose running from the pump or system to the cleaner head.

Robotic cleaners have been developed to routinely navigate about the pool walls, cleaning as they go. Robotic cleaners do not require an external filtration system to be running or connected thereto. Instead, a pumping system, utilizing a large propeller style impeller continuously circulates a large quantity of water to produce the required suction to remove debris from the pool floor. This water is further circulated through an internal filter assembly capturing debris therein. This pumping system results in a substantial reduction in operating costs compared to a cleaner that must be connected to a pool filtration system. A rotating cylindrical roller (formed of foam and/or provided with a brush) can be included on the bottom of the unit to scrub the pool walls. Electric pool cleaners often do not require an external source of pressurized water for propulsion purposes. Instead, electric pool cleaners generally include a drive system that can operate drive tracks or wheels associated with the cleaner, causing the cleaner to traverse the bottom surface of the pool floor.

Accordingly, there is a need for a pool cleaner that is capable of cleaning both the pool water surface and the pool walls, and does not require an external source of pressurized water.

SUMMARY

The present disclosure relates to an electric top bottom cleaner for pools or spas that includes internal pumps for suction and propulsion purposes. The pool cleaner includes a housing having a front end, a rear end, a first side, a second side, a bottom wall, and a top wall, with a first aperture extending through the bottom wall and a second aperture extending through the top wall. The first and second apertures could include any opening having any desired shape or size. A tube extends through the housing between the first aperture and the second aperture. A debris retention mechanism is connectable to the housing. A first pump, second pump, and third pump are positioned within the housing. The first pump is in fluidic communication with a forward thrust jet nozzle positioned generally at a top of the rear end and at least one vacuum jet nozzle positioned to discharge water through the tube. The second pump is in fluidic communication with a lift/thrust jet nozzle positioned generally at a bottom of the rear end and a skim jet nozzle positioned to discharge water toward the debris retention mechanism. The third pump is in fluidic communication with at least one spinout jet nozzle positioned on the housing to generally offset a regular course of travel of the pool cleaner. A power supply is external to the housing and provides power to the first pump, the second pump, and the third pump. A controller is connected to and provides control instructions to the first pump, the second pump, and the third pump to switch the pool cleaner between a bottom mode, a top mode, and a spinout mode. When the pool cleaner is in the bottom mode, the first pump is energized and pumps fluid to the forward thrust jet nozzle and the at least one vacuum jet nozzle, the forward thrust jet nozzle propels the pool cleaner in a generally forward direction and the at least one vacuum jet nozzle discharges water through the tube and into the debris retention mechanism. When the pool cleaner is in the top mode, the second pump is energized and pumps fluid to the lift jet nozzle and the skim jet nozzle, the lift/thrust jet nozzle propels the pool cleaner in a generally forwardly and upwardly direction and the skim jet nozzle discharges water into the debris retention mechanism. When in the spinout mode, the third pump is energized and pumps fluid to the at least one spinout jet nozzle, the at least one spinout jet nozzle discharges water to offset the general path of the pool cleaner.

In another aspect, the pool cleaner includes a housing having a front end, a rear end, a first side, a second side, a bottom wall, and a top wall, with a first aperture extending through the bottom wall and a second aperture extending through the top wall. A tube extends through the housing and between the first aperture and the second aperture. A debris retention mechanism is connectable to the housing. A pump, a first valve, and a second valve are positioned within the housing. The first valve receives fluid from the pump, and is in fluidic communication with the second valve and at least one spinout jet nozzle positioned on the housing to generally offset a regular course of travel of the pool cleaner. The second valve receives fluid from the first valve, and is in fluidic communication with a forward thrust jet nozzle positioned generally at a top of the rear end of the housing, at least one vacuum jet nozzle positioned to discharge water through the tube, a lift/thrust jet nozzle generally positioned at a bottom of the rear end of the housing, and a skim jet nozzle positioned to discharge water toward the debris retention mechanism. An electric power supply is external to the housing and provides electric power to the pump. A controller is in communication with the pump, the first valve, and the second valve. The controller provides control instructions to the pump, the first valve, and the second valve to switch the first valve between a first position and a second position, and to switch the second valve between a third position and a fourth position. When the first valve is in the first position it provides pressurized fluid to the at least one spinout jet nozzle which discharges fluid to offset the general path of the pool cleaner. When the first valve is in the second position it provides pressurized fluid to the second valve. When the first valve is in the second position and the second valve is in the third position the second valve provides pressurized fluid to the forward thrust jet nozzle and the at least one vacuum jet nozzle, such that the forward thrust jet nozzle propels the pool cleaner in a generally forward direction and the at least one vacuum jet nozzle discharges water through the tube. When the first valve is in the second position and the second valve is in the fourth position the second valve provides pressurized fluid to the lift/thrust jet nozzle and the skim jet nozzle, such that the lift/thrust jet nozzle propels the pool cleaner in a generally forwardly and upwardly direction and the skim jet nozzle discharges water into the debris retention mechanism.

In another aspect, the pool cleaner includes a housing defining an internal chamber, a debris retention mechanism, a first pump, a second pump, a third pump, and a controller. The first pump, second pump, and third pump are positioned within the internal chamber and receive power from a power supply external from the pool cleaner. The controller controls operation of the first, second, and third pumps. The first pump provides pressurized water to at least one vacuum jet nozzle for removing debris from a pool surface and at least one forward thrust jet nozzle for providing forward propulsion of the pool cleaner. The second pump provides pressurized water to at least one lift/thrust jet nozzle for propelling the pool cleaner to a pool surface and providing forward propulsion of the pool cleaner, and a skim jet nozzle for discharging water into the debris retention mechanism. The third pump provides pressurized water to at least one spinout jet nozzle for discharging fluid to offset the general path of the pool cleaner.

In another aspect, the pool cleaner includes a housing defining an internal chamber, a debris retention mechanism, a pump positioned within the internal chamber, a first valve positioned within the internal chamber, a second valve positioned within the internal chamber, a controller, and a power supply. The controller controls operation of the pump, the first valve, and the second valve, switching the first valve between a first position and a second position, and the second valve between a third position and a fourth position. The power supply provides power to the pump, the controller, the first valve, and the second valve. When the first valve is in the first position it provides pressurized fluid to at least one spinout jet nozzle for discharging fluid to offset the general path of the pool cleaner. When the first valve is in the second position it provides pressurized fluid to the second valve. When the first valve is in the second position and the second valve is in the third position the second valve provides pressurized fluid to at least one vacuum jet nozzle for removing debris from a pool surface and at least one forward thrust jet nozzle for providing forward propulsion of the pool cleaner. When the first valve is in the second position and the second valve is in the fourth position the second valve provides pressurized fluid to at least one lift/thrust jet nozzle for propelling the pool cleaner to a pool surface and providing forward propulsion of the pool cleaner, and a skim jet nozzle for discharging water into the debris retention mechanism.

In some aspects, the pool cleaner can also include a front wheel rotatably positioned on the front end of the housing, a first rear wheel rotatably positioned on the first side of the housing, and a second rear wheel rotatably positioned on the second side of the housing. The front wheel, the first rear wheel, and the second rear wheel can support the housing on a surface of a pool. In other aspects, the pool cleaner can include two wheels rotatably positioned on the first side of the housing and two wheels rotatably positioned on the second side of the housing that can support the housing on a surface of a pool. In one aspect, the rear wheels can be driven by an electric motor. Further, the rear wheels could be paddle wheels, which could be propelled by gears using pressurized water or by an electric motor. A rotating cylindrical roller (formed of foam and/or provided with a brush) could be included on the bottom of the pool cleaner to scrub the pool walls.

In still other aspects, the pool cleaner can also include a vacuum jet nozzle manifold containing the at least one vacuum jet nozzle and positioned within the tube. The jet nozzle manifold receives fluid from the second valve and directs the fluid to the at least one vacuum jet nozzle.

In some aspects, the pool cleaner can include one, or a plurality, of vacuum jet nozzles, for example, two, three, four, or more vacuum jet nozzles. The vacuum jet nozzles can be positioned and arranged to discharge fluid in a helical path.

The pool cleaner can include a timer mechanism associated with the power source and the controller allowing the control operations to be programmed.

In one aspect, a pump for use with a pool cleaner is provided. The pump includes an inlet for receiving water, a body defining a chamber, and a plurality of vanes positioned in the chamber. The vanes are rotatable in a first direction and in a second direction. A first valve is provided adjacent a first outlet, and a second valve is provided adjacent a second outlet. When the vanes rotate in a first direction, the vanes pressurize the water such that the water forces the first valve to open, allowing pressurized water to exit through the first outlet, and allowing the second valve to remain closed. When the vanes rotate in a second direction, the vanes pressurize the water such that the water forces the second valve to open, allowing pressurized water to exit through the second outlet, and allowing the first valve to remain closed.

BRIEF DESCRIPTION OF THE DRAWINGS

The foregoing features of the invention will be apparent from the following Detailed Description, taken in connection with the accompanying drawings, in which.

DETAILED DESCRIPTION

The present invention relates to an automatic electric top bottom swimming pool cleaner with internal pumps, as discussed in detail below in connection with FIGS. 1-12.

Figure 1:
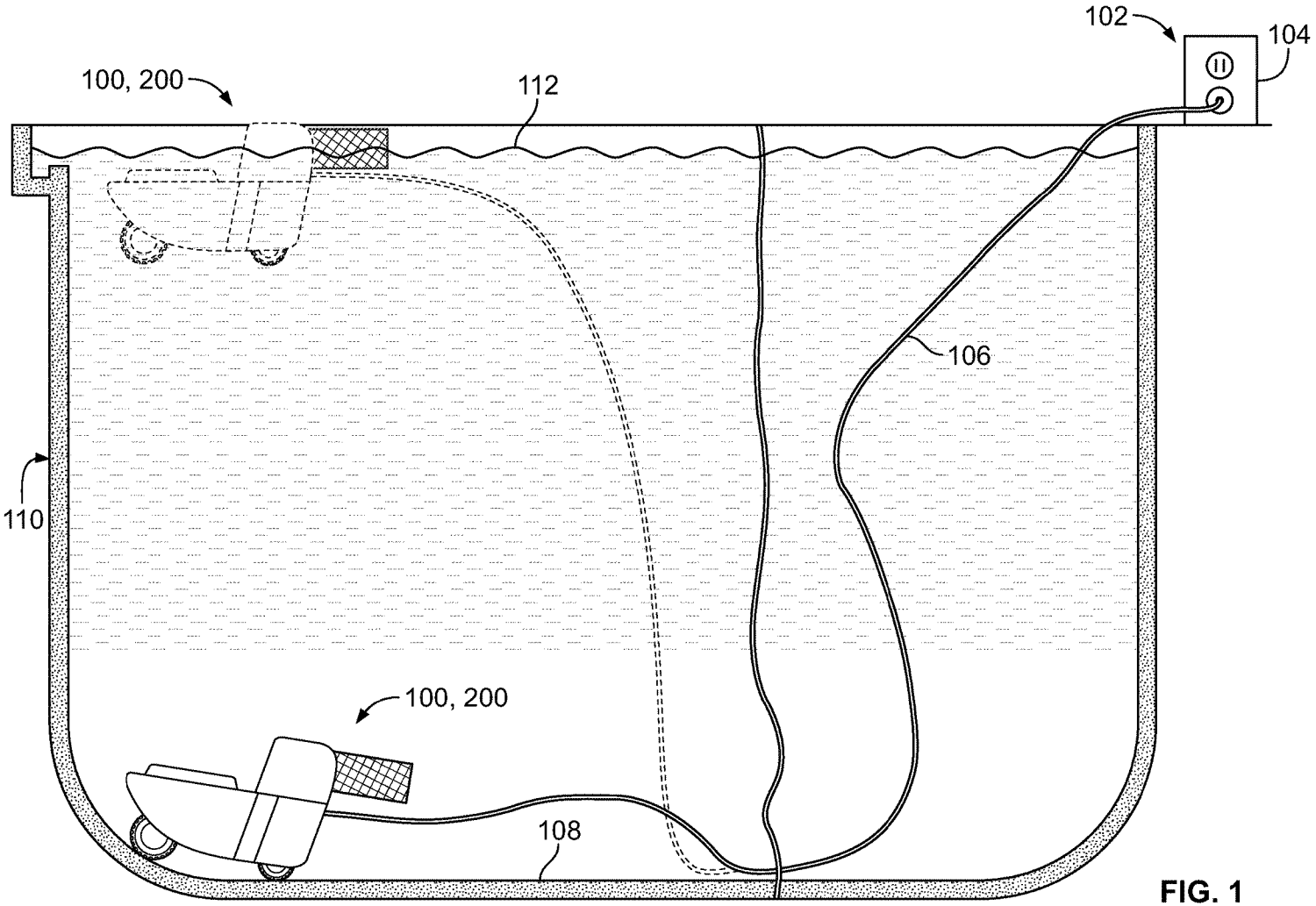
FIG. 1 is a schematic representation depicting the overall operation of a pool cleaner of the present disclosure.
Figure 2:
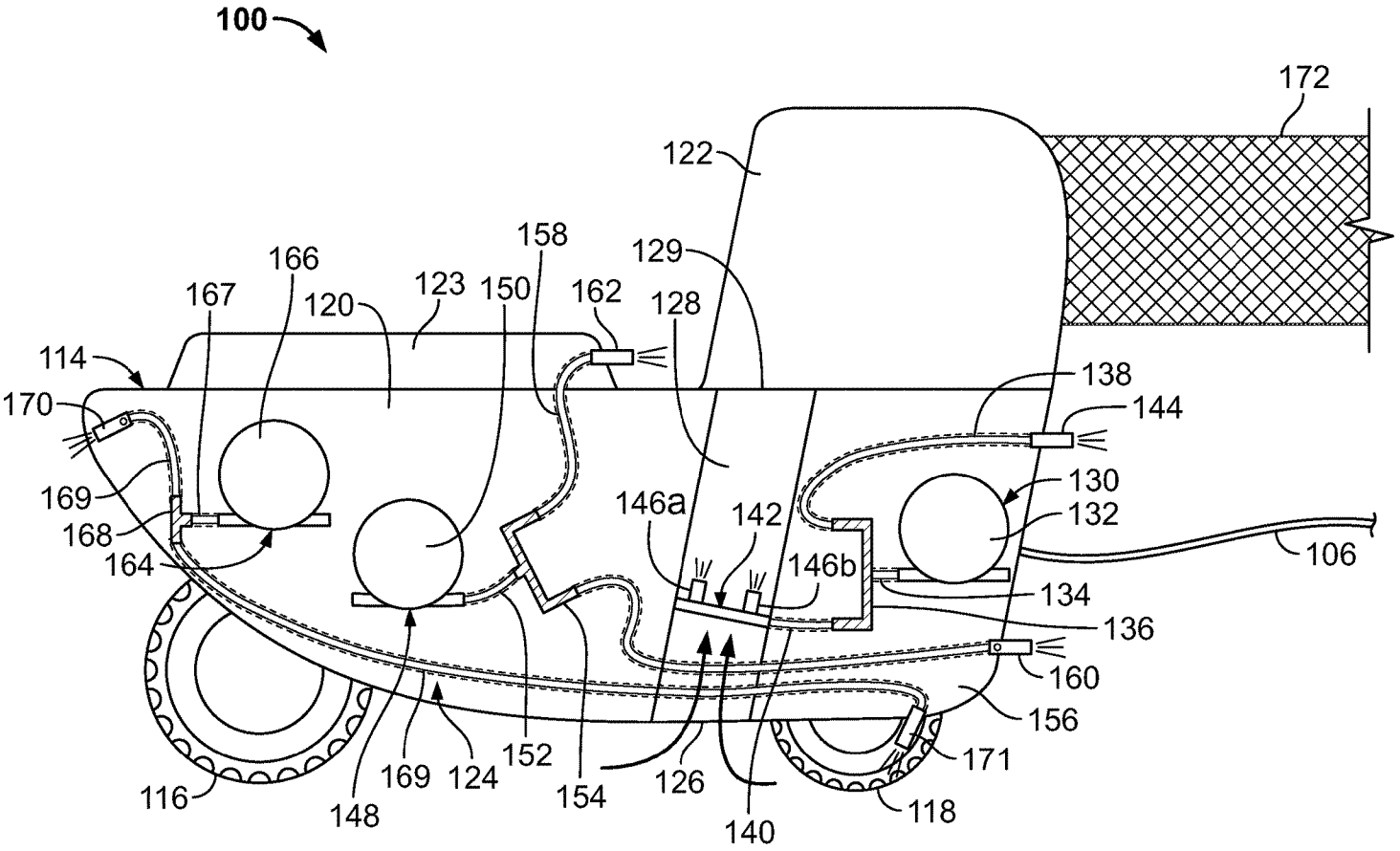
FIG. 2 is a side elevational view of the pool cleaner according to a first exemplary embodiment of the present disclosure shown in FIG. 1.

With initial reference to FIGS. 1 and 2, a cleaner assembly generally includes a cleaner 100 and a power source such as an external power supply 102. The power supply 102 is generally housed in a transformer/control box 104. A power/control cable 106 is in communication with, and extends between, the transformer/control box 104 and the cleaner 100, placing the two in electrical communication. In an exemplary embodiment, the pool cleaner 100 is an electric pool cleaner. Additional and/or alternative power sources are contemplated.

As shown in FIG. 1, the cleaner 100 is adapted to clean an interior wall 108 of a swimming pool 110 and an upper surface 112 of water contained therein. As a result, the cleaner 100, in typical operation, alternates between two cleaning operations. A first cleaning operation is a water cleaning mode ("top mode") in which the cleaner 100 rises to, and travels along, the upper surface 112 of the water collecting and removing floating debris therefrom. A second cleaning operation is a wall surface cleaning mode ("bottom mode") in which the cleaner 100 descends proximate to the interior wall 108 of the swimming pool 110 to remove debris therefrom. The cleaner 100 is also adapted to periodically alternate to a turn/backup mode from the bottom or top mode, in which the cleaner 100 turns away from the direction of its generally forward motion in an arcuate sideward path, or moves in a backwards direction, so as to prevent the cleaner 100 from being trapped by an obstruction (e.g., a corner of a swimming pool).

Referring to FIG. 2, the cleaner 100 generally includes a housing or body 114, front center wheel 116, and rear wheels 118. The housing or body includes a chassis 120 having a cover 122 and a decking 123 removably or fixedly attached to the chassis 120. The chassis 120 generally defines a central cavity 124 for housing various electrical components, mechanical components, tubing, and wiring, generally associated with the various pumping systems, which are discussed in greater detail below. A vacuum inlet 126 is formed on the underside of the chassis 120 while a suction tube 128 extends from the vacuum inlet 126 in an upward and rearward direction. Housed within the central cavity 124 of the chassis 120 are a plurality of pumping systems.

Figure 3:
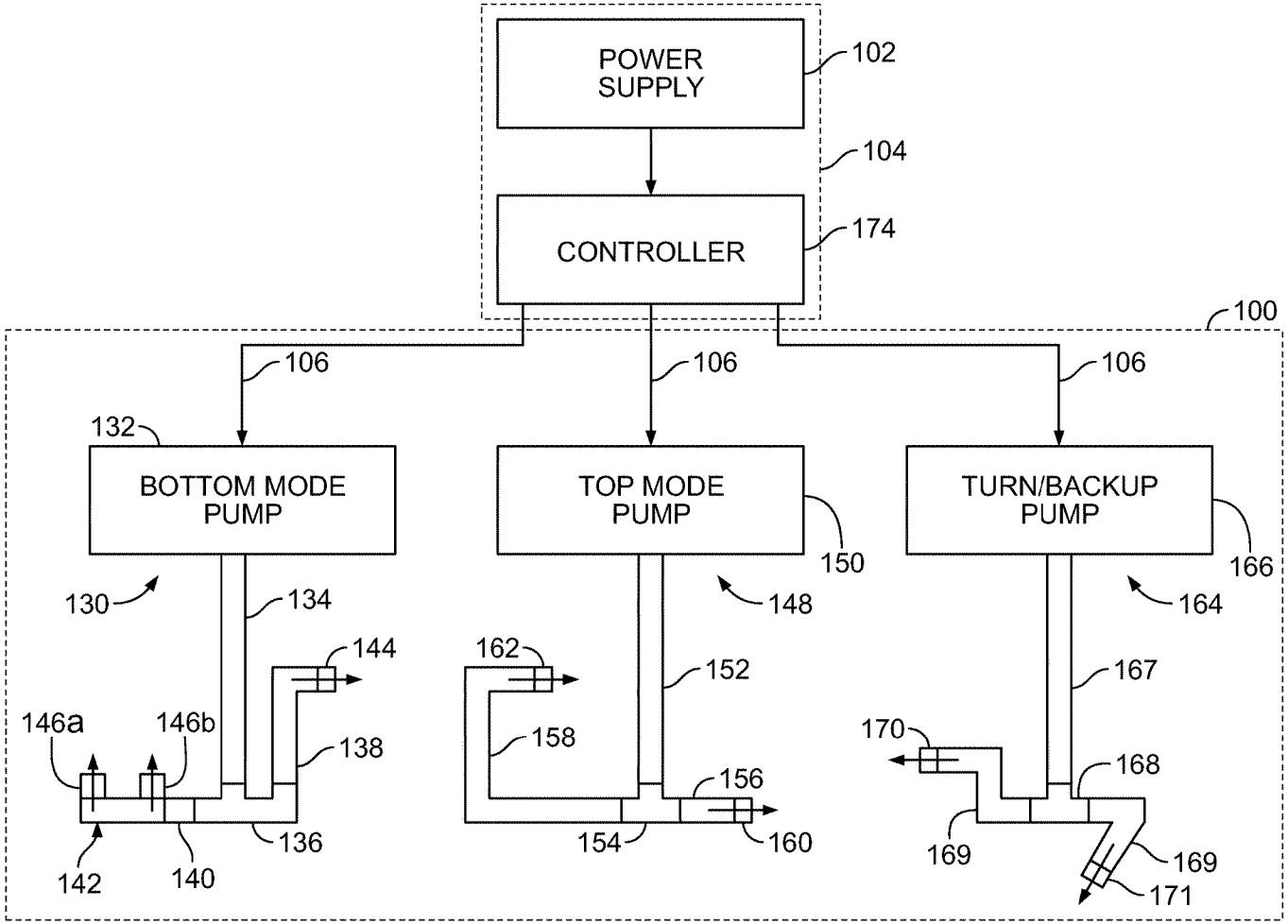
FIG. 3 is a block diagram depicting the electrical connections and water flow distribution of the first exemplary embodiment of the present disclosure.

FIG. 3 is a block diagram depicting the electrical connections and water flow distribution of the present invention. The bottom mode pumping system 130 includes a bottom mode pump 132, an outlet hose 134, a hose splitter 136, a forward thrust jet hose 138, a vacuum jet hose 140, a vacuum jet nozzle manifold 142, a forward thrust jet nozzle 144, and a plurality of vacuum jet nozzles 146*a*, 146*b*. The top mode pumping system 148 includes a top mode pump 150, an outlet hose 152, a hose splitter 154, a thrust jet hose 156, a skim jet hose 158, a lift/thrust jet nozzle 160, and a skim jet nozzle 162. The turn/backup pumping system 164 includes a turn/backup pump 166, an outlet hose 167, a hose splitter 168, spin-out jet hoses 169, one or more front spin-out jet nozzles 170 (front turn/backup jet nozzles), and one more rear spin-out jet nozzles 171 (rear turn/backup jet nozzles).

Each pump 132, 150, 166 includes an inlet for receiving a constant supply of water, which is drawn from the swimming pool 110 when the cleaner 100 is submerged. Specifically, the cleaner 100 could include a water supply inlet (not shown) extending through the chassis 120. A hose (not shown) could be attached to the water supply inlet and run to a splitter that divides the hose into three separate hoses each running to a respective pump inlet. The hose and water supply inlet place the pumps 132, 150, 166 in fluidic communication with the pool water, so that the pumps 132, 150, 166 can draw water from the swimming pool 110 and have a constant supply of water when the cleaner 100 is submerged in the swimming pool 110. Further, this allows the pumps 132, 150, 166 to be provided with a constant supply of water when the cleaner 100 is submerged in the swimming pool 110. In some embodiments, the water supply inlet could extend through a top wall of the chassis 120 or through a top of the decking 123 such that the effects of gravity, e.g., the pressure of the pool water, allows for the pumps 132, 150, 166 to have a constant supply of water, preventing any cavitation or dry running from occurring in the pumps 132, 150, 166. In an alternate embodiment, the chassis 120 could not be fluid tight, or could include one or more openings, such that the central cavity 124 of the cleaner 100 could be exposed to pool water. In this embodiment, each pump 132, 150, 166 could pump water from the chassis 120 through their respective pumping systems 130, 148, 164.

Generally, the pumps 132, 150, 166 include an impeller which increase the volumetric flow rate of the water through the pump causing an increase in the water pressure, which exits the pump. The water that leaves the pump is injected through each respective nozzle 144, 146*a*, 146*b*, 160, 162, 170, 171 at a high pressure and a high velocity. In some instances, e.g., for the vacuum jet nozzles 146*a*, 146*b*, this high velocity water is injected into a suction tube 128 to create a vacuum effect for removing debris. In other instances, e.g., for the forward thrust jet nozzle 144, the lift/thrust jet nozzle 160, the front spin-out jet nozzle 170, and the rear spin-out jet nozzle 171, this high pressure water is utilized to provide propulsion. In still other instances, e.g., for the skim jet nozzle 162, this high pressure water is utilized to transfer debris into the debris retention mechanism 172 or to keep debris from floating out of the debris retention mechanism 172.

Figure 4A:
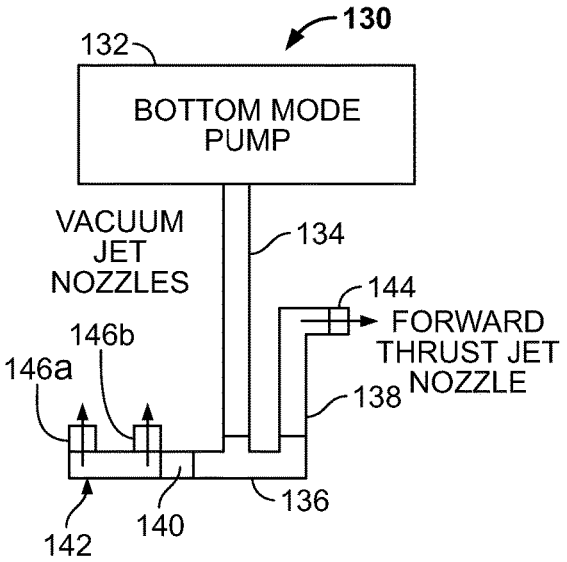
FIG. 4A is a block diagram depicting the water flow distribution of the bottom mode pump of the present disclosure.

FIG. 4A is a block diagram depicting the water flow distribution of the bottom mode pump 132. The bottom mode pumping system 130 includes the vacuum jet nozzle manifold 142, which is mounted adjacent to the vacuum inlet 126 and oriented such that the vacuum jet nozzles 146*a*, 146*b* discharge a high velocity stream of water through the suction tube 128 and into the debris retention mechanism 172, causing a suction effect and removing debris from the interior wall 108 of the swimming pool 110 when the cleaner 100 is in the bottom mode. Two vacuum jet nozzles 146*a*, 146*b* are illustrated. However, it is contemplated that the pool cleaner 100 can include one, or a plurality, of vacuum jet nozzles, for example, two, three, four, or more vacuum jet nozzles could be used. The vacuum jet nozzles can be arranged in various orientations, such as triangular, quadrilateral, or other geometrically related orientation as may be known in the art. Possible vacuum jet nozzle orientations are illustrated in FIGS. 10A-10D. The bottom mode pumping system 130 also includes the forward thrust jet nozzle 144 that extends through a rear wall of a rear portion of the chassis 120. The forward thrust jet nozzle 144 is adapted for discharging a high velocity stream of water to propel the cleaner 100 in a generally forward path when the cleaner 100 is in the bottom mode. It is contemplated that in some embodiments more than one forward thrust jet nozzle 144 could be utilized.

Figure 4B:
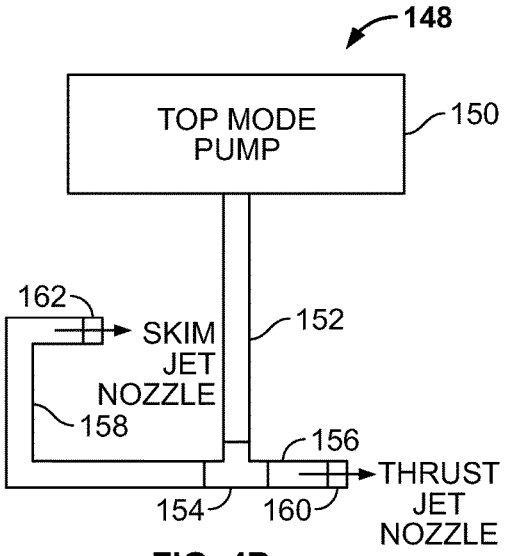
FIG. 4B is a block diagram depicting the water flow distribution of the top mode pump of the present disclosure.

FIG. 4B is a block diagram depicting the water flow distribution of the top mode pump 150. The top mode pumping system 148 includes a lift/thrust jet nozzle 160 and a skim jet nozzle 162. The lift/thrust jet nozzle 160 extends through the rear wall of the rear portion of the chassis 120 and is adapted for discharging a high velocity stream of water so as to place the cleaner 100 proximate to the upper surface 112 and move the cleaner 100 along same when the cleaner 100 is in its top mode. It is contemplated that in some embodiments more than one lift/thrust jet nozzle 160 could be utilized. The chassis 120 is equipped with the decking 123 located at a frontal portion of the chassis 120 and projecting upwardly therefrom. The skim jet nozzle 162 is located on, and extends through, a wall of a decking 123, which is attached to the chassis 120. The skim jet nozzle 162 is adapted for discharging a high velocity stream of water so as to drive any debris floating on the upper surface 112 of the swimming pool 110 into a debris retention mechanism 172 connected to the cover 122. It is contemplated that in some embodiments the cleaner 100 could be equipped with debris retention jets for retaining any collected debris within the debris retention mechanism 172, and restricting the collected debris from exiting therefrom. The contemplated debris retention jets could be connected to the bottom mode pumping system 130, the top mode pumping system 148, and/or the turn/backup pumping system 164 so that the debris is always retained in the debris retention mechanism 172.

Figure 4C:
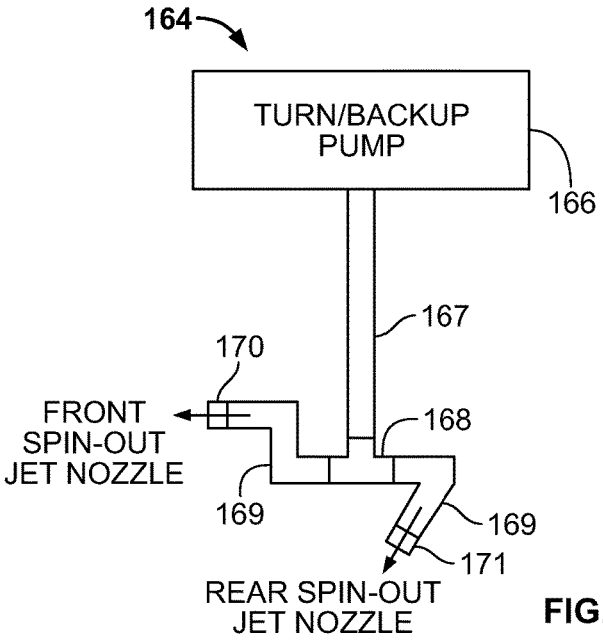
FIG. 4C is a block diagram depicting the water flow distribution of the turn/backup pump of the present disclosure.

FIG. 4C is a block diagram depicting the water flow distribution of the turn/backup pump 166. The turn/backup pumping system 164 includes a front spin-out jet nozzle 170 and a rear spin-out jet nozzle 171. The front spin-out jet nozzle 170 is mounted to a front wall section of the chassis 120, while the rear spin-out jet nozzle 171 is mounted to the rear wall of the chassis 120. More particularly, the front and rear spin-out jet nozzles 170, 171 are angled generally downwardly and are oriented at an angle relative to the longitudinal axis of the cleaner 100 so as to cause the cleaner 100 to spin in a predetermined direction (e.g., in a clockwise direction) and to thereby move away from its forward path in an arcuate sideward path, when the cleaner 100 is in the turn/backup mode. Because both the front and rear spin-out jet nozzles 170, 171 are directed downwardly, when the cleaner 100 is in the turn/backup mode, it is lifted vertically, facilitating the spinning or rotating motion of the cleaner 100. Alternatively, the front and rear spin-out nozzles 170, 171 can have different orientations, and can be positioned at different locations on the cleaner 100. For instance, the rear spin-out jet nozzle 171 can be positioned on the central axis of the rear wall of the chassis 120 and can be oriented substantially horizontally so as to produce a horizontally discharged spin-out jet directed toward a vertical side wall of the chassis 120, thereby further facilitating the rotation of the cleaner 100. Alternatively, for instance, the front and rear spin-out jet nozzles 170, 171 could be oriented such that the cleaner 100 can move directly backwards and turn.

The cover 122 could include a deck and a pair of side walls projecting from the deck. The deck could include an access opening formed therein and an enclosure wall extending from the deck around the access opening. A door (e.g., a cap) could be pivotally mounted to the deck for closing the access opening. The cover 122 could also include a cross member spanning between the sidewalls. A hole is formed in the deck adjacent a rear end thereof. More particularly, the hole is sized and shaped so as to receive the upper end 129 of the suction tube 128. The upper end 129 of the suction tube 128 is positioned flush with the deck of the cover 122. A rear debris opening is defined by the deck, the side walls, and the cross member. A slot is formed around the rear debris opening. Diverter wheels could be rotatably mounted between the cover 122 and the chassis 120 along the periphery of the chassis 120 for deflecting the cleaner 100 away from an obstruction or a wall of the swimming pool 110.

The debris retention mechanism 172 is removably attached to the cleaner 100 for receiving debris through the rear debris opening. The debris retention mechanism 172 can include a ring defining a mouth of the debris retention mechanism 172. The ring can be removably received in the slot and retained therein by a retainer member for attaching the debris retention mechanism 172 to the cleaner 100. The debris retention mechanism 172 can be a filter bag or a filter bucket.

A front center wheel 116 is mounted to a front portion of the chassis 120, while rear wheels 118 are mounted to the side walls of the chassis 120. The front and rear wheels 116, 118 are freely rotatable and are adapted to support the chassis 120 and hence the cleaner 100 on the interior wall 108 of the swimming pool 110. In other embodiments, the pool cleaner 100 can include two wheels rotatably positioned on the first side of the chassis 120 and two wheels rotatably positioned on the second side of the chassis 120 that can support the chassis 120 on a surface of a pool.

Referring again to FIG. 3, the power/control cable 106 is connected to the cleaner 100 (see FIG. 1) and provides power and commands from the transformer/control box 104, which includes a power supply 102 and a controller 174, to the bottom mode pump 132, the top mode pump 150 and the turn/backup pump 166. The transformer/control box 104 transforms a 120 VAC or 240 VAC (alternating current) input into a 24 VDC (direct current) output, respectively. The 24 VDC is communicated to the cleaner 100, wherein it powers a plurality of pump motors associated with each of the bottom mode pump 132, the top mode pump 150 and the turn/backup pump 166. The controller 174 could be a PC board controller that can communicate with the pumps 132, 150, 166 of the cleaner 100. For example, the controller 174 could turn on one pump at a time based upon a desired mode of operation, e.g., bottom mode, top mode, and/or turn/backup mode. The controller 174 could include a control device, which could be any one of a screen and graphical user interface, mechanical switch, electronic switch, or program included in the controller, which allows a user to quickly switch between the operational modes when necessary.

The controller 174 could include sensors, such as an accelerometer, a gyroscope, and/or a tilt switch for automatically navigating the cleaner 100 around the swimming pool 110. The controller 174 could be equipped with direction and orientation sensing apparatus, such as a compass, GPS and/or a multi-axis motion sensor to aid in identifying the position and orientation of the cleaner 100 to the controller 174 such that the controller 174 can track the actual path of the cleaner 100 and compare it to a map of the pool surfaces that require cleaning.

Figure 5:
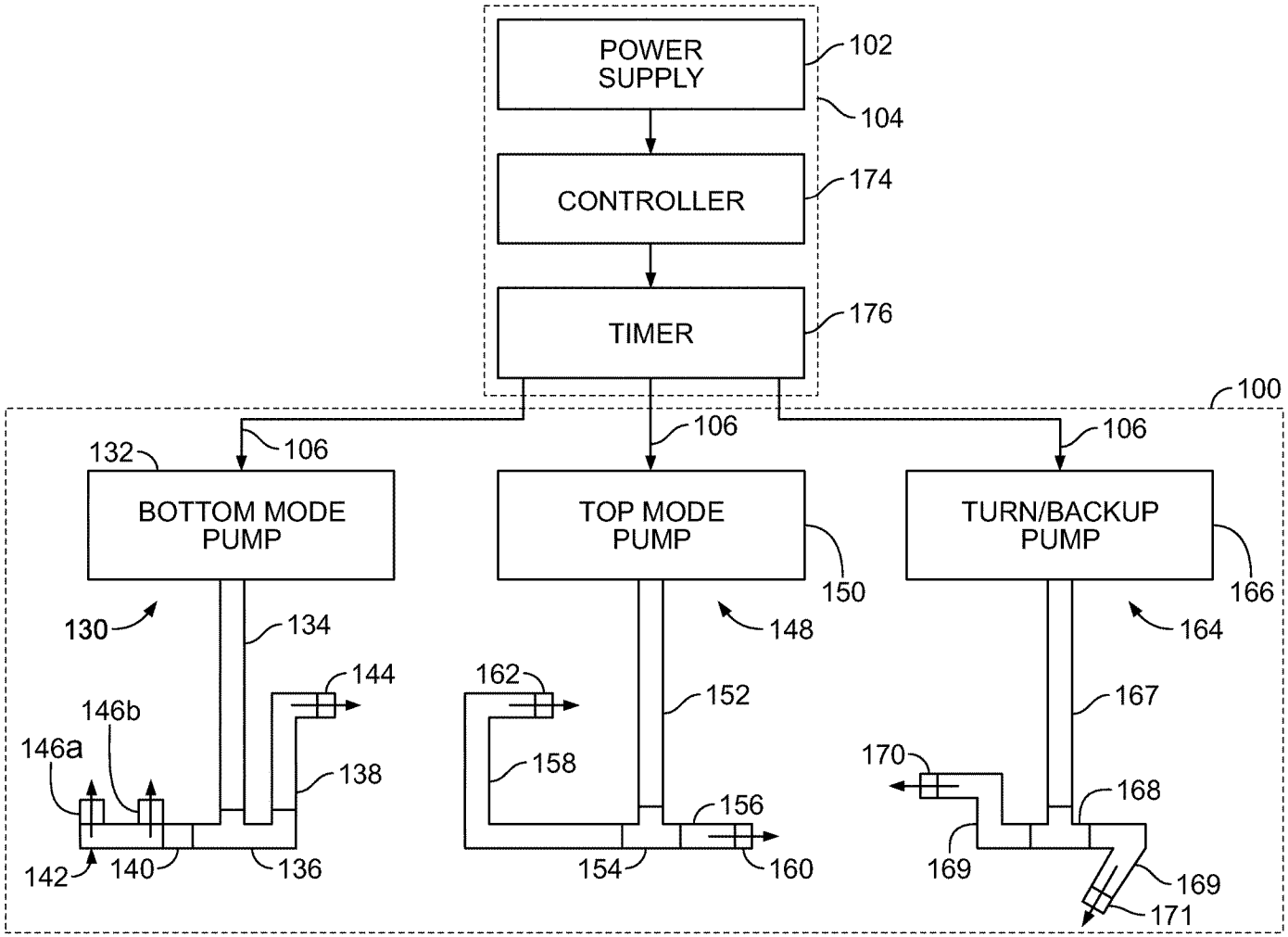
FIG. 5 is a block diagram depicting the electrical connections and water flow distribution of a second exemplary embodiment of the present disclosure.

In an alternate embodiment, the transformer/control box 104 could include a timer 176 that is in electrical communication with the power supply 102, the controller 174, and the pumps 132, 150, 166, as illustrated in FIG. 5, which is a block diagram depicting the electrical connections and water flow distribution of a second exemplary embodiment of the present invention. The timer 176 allows the cleaner 100 to be programmed so that the controller 174 automatically switches between the operational modes without the need for user input. This is beneficial because a user may not be available to switch the cleaner 100 between the modes during the day, which often results in the cleaner 100 functioning for an entire day in bottom mode such that the upper surface 112 of the water is never skimmed and cleaned of floating debris. The timer 176 could either be factory set or can be adapted such that input devices, e.g., remote controls, home automation units, cell phones, graphical user interfaces, etc., connected to the controller 174 allow a consumer to adjust the timing for the best coverage pattern for their pool size/shape. Alternatively, the timer 176 could be a mechanical timer attached to the pumps 132, 150, 166. The timer 176 could be situated in any desired location, such as in the power supply 102 or in other components of the cleaner 100.

Figure 6:
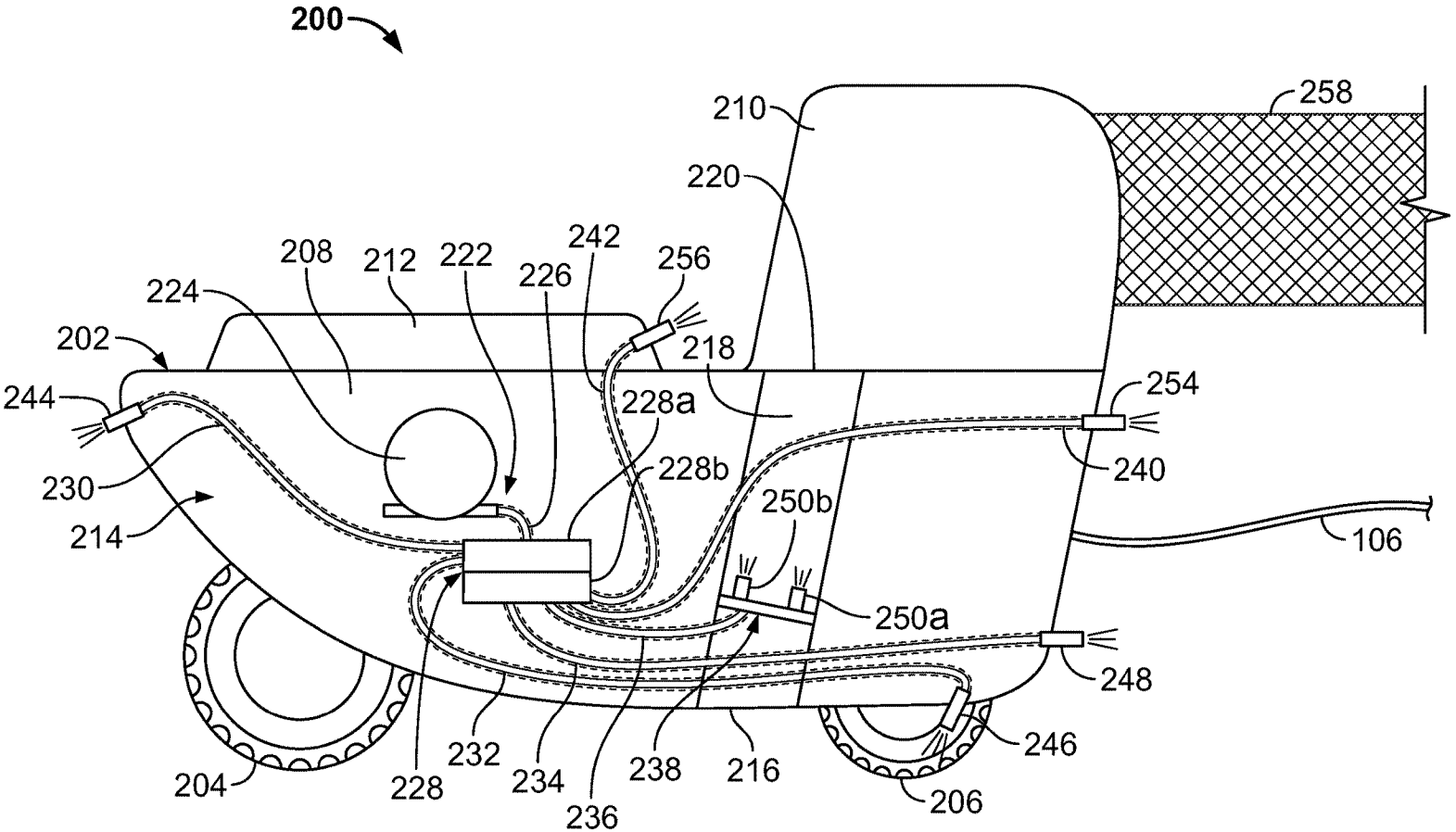
FIG. 6 is a side elevational view of the pool cleaner of a third embodiment of the present disclosure.

FIG. 6 is a side elevational view of a third embodiment of the pool cleaner of the present invention. The cleaner 200 generally includes a housing or body 202, front center wheel 204, and rear wheels 206. The housing or body includes a chassis 208 having a cover 210 and a decking 212 removably or fixedly attached to the chassis 208. The chassis 208 generally defines a central cavity 214 for housing various electrical components, mechanical components, tubing, and wiring, generally associated with the various pumping systems, which are discussed in greater detail below. A vacuum inlet 216 is formed on the underside of the chassis 208 while a suction tube 218 extends from the vacuum inlet 216 in an upward and rearward direction, terminating at an upper end 220. Housed within the central cavity 214 of the chassis 208 is a pumping system 222.

Figure 7:
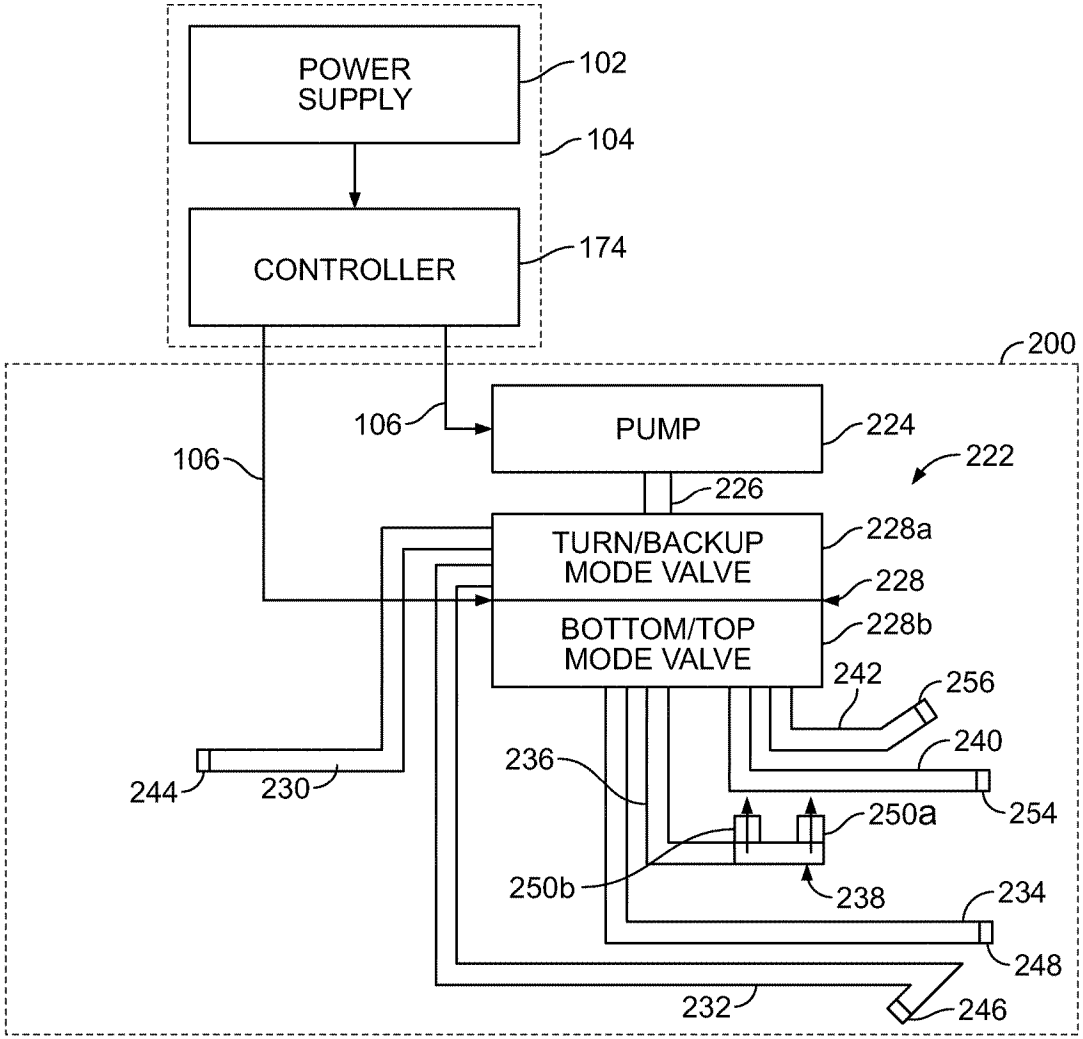
FIG. 7 is a block diagram depicting the electrical connections and water flow distribution of the third exemplary embodiment of the present disclosure.

FIG. 7 is a block diagram depicting the electrical connections and water flow distribution of the third exemplary embodiment of the present invention. The pumping system 222 includes a pup 224, an outlet hose 226, a valve assembly 228, a front spin-out jet hose 230, a rear spin-out jet hose 232, a lift/thrust jet hose 234, a vacuum jet hose 236, a vacuum jet nozzle manifold 238, a forward thrust jet hose 240, a skim jet hose 242, a front spin-out jet nozzle 244, a rear spin-out jet nozzle 246, a lift/thrust jet nozzle 248, a first vacuum jet nozzle 250*a*, a second vacuum jet nozzle 250*b*, a forward thrust jet nozzle 254, and a skim jet nozzle 256.

The pump 224 includes an inlet for receiving a constant supply of water, which is drawn from the swimming pool 110 when the cleaner 200 is submerged. Specifically, the cleaner 200 could include a water supply inlet (not shown) extending through the chassis 208. A hose (not shown) could be attached to the water supply inlet and run to the pump 224 inlet. The hose and water supply inlet place the pump 224 in fluidic communication with the pool water, so that the pump 224 can draw water from the swimming pool 110 and has a constant supply of water when the cleaner 200 is submerged in the swimming pool 110. In some embodiments, the water supply inlet could extend through a top wall of the chassis 208 or through a top of the decking 212 such that the effects of gravity, e.g., the pressure of the pool water, allows for a constant supply of water to be present, preventing any cavitation or dry running from occurring in the pump 224. In an alternate embodiment, the chassis 208 is not fluid tight, but could include one or more openings, such that the central cavity 214 of the cleaner 200 could be exposed to pool water. In this embodiment, the pump 224 could pump water from the chassis 208 through the pumping system 222.

Generally, the pump 224 is constructed in accordance with, and could be the same type of pump as, the bottom mode pump 132, the top mode pump 150, and the turn/backup pump 166, which are discussed above with respect to FIGS. 2-5. As such, it is not necessary to describe the pump 224 further.

The valve assembly 228 includes a turn/backup mode valve 228*a* and a bottom/top mode valve 228*b*. The turn/backup mode valve 228*a* and a bottom/top mode valve 228*b* could be adjacent to each other or a hose could be located between the turn/backup mode valve 228*a* and the bottom/top mode valve 228*b*. The valve assembly 228 redirects water flow between the hoses 230, 232, 234, 236, 240, 242, and the respective nozzles 244, 246, 248, 250*a*, 250*b*, 254, 256. The hoses 230, 232, 234, 236, 240, 242 and nozzles 244, 246, 248, 250*a*, 250*b*, 254, 256 are split into three separate groups that correspond to the three separate operational modes, e.g., the turn/backup mode, the top mode, and the bottom mode. The turn/backup mode valve 228*a* is a two position solenoid valve that switches the flow from the pump 224 between a first position where the water flow is directed to the front spin-out jet hose 230, the rear spin-out jet hose 232, the front spin-out jet nozzle 244, and the rear spin-out jet nozzle 246, and does not flow to the bottom/top mode valve 228*b*, and a second position where the water flow is directed to the bottom/top mode valve 228*b*. Similarly, the bottom/top mode valve 228*b* is a two position solenoid valve that switches the flow provided thereto between the bottom mode (e.g., the vacuum jet hose 236, the vacuum jet nozzle manifold 238, the forward thrust jet hose 240, the vacuum jet nozzles 250*a*, 250*b*, and the forward thrust jet nozzle 254) and the top mode (e.g., the lift/thrust jet hose 234, the skim jet hose 242, the lift/thrust jet nozzle 248, and the skim jet nozzle 256).

Figure 8A:
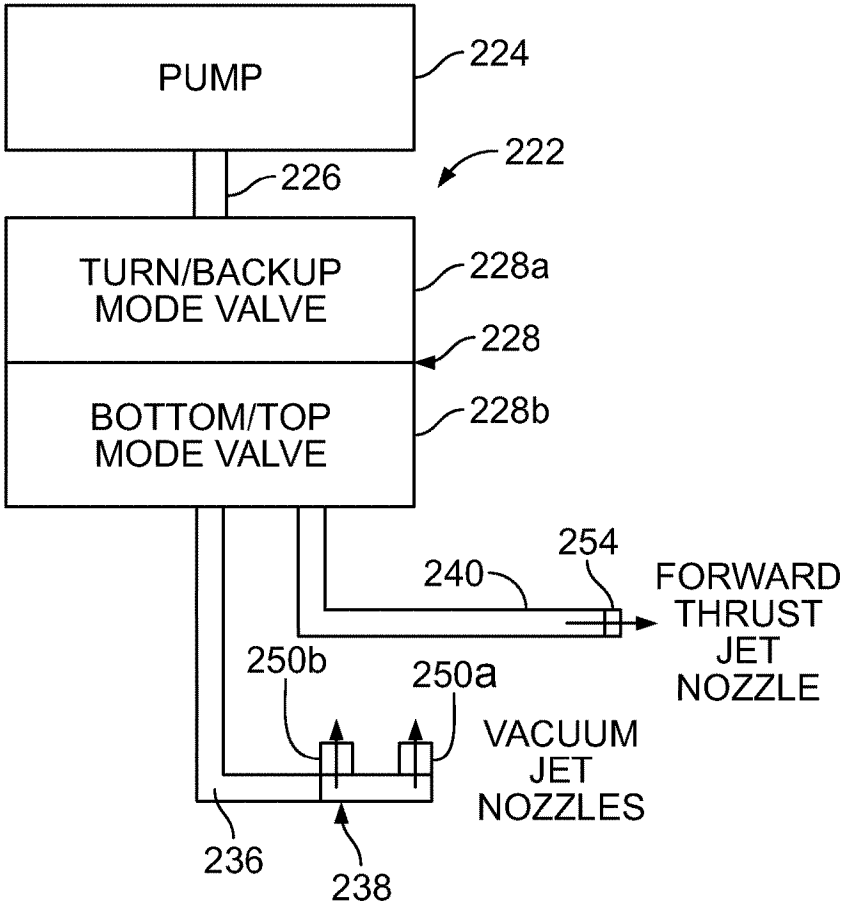
FIG. 8A is a block diagram depicting the water flow distribution of the bottom mode operation of the third embodiment of the present disclosure.

FIG. 8A is a block diagram depicting the water flow distribution of the bottom mode operation isolated from the other modes. Essentially, FIG. 8A illustrates the water distribution when the cleaner 200 is in bottom mode. The bottom mode comprises the vacuum jet hose 236, the vacuum jet nozzle manifold 238, the forward thrust jet hose 240, the first vacuum jet nozzle 250*a*, the second vacuum jet nozzle 250*b*, and the forward thrust jet nozzle 254. The vacuum jet nozzle manifold 238 is mounted adjacent to the vacuum inlet 216 and oriented such that the vacuum jet nozzles 250*a*, 250*b* discharge a high velocity stream of water through the suction tube 218 and into the debris retention mechanism 258, causing a suction effect and removing debris from the interior wall 108 of the swimming pool 110 when the cleaner 200 is in its wall surface cleaning or bottom mode. Two vacuum jet nozzles 250*a*, 250*b* are illustrated. However, it is contemplated that the pool cleaner 200 can include one, or a plurality, of vacuum jet nozzles, for example, two, three, four, or more vacuum jet nozzles could be used. The vacuum jet nozzles can be arranged in various orientations, such as triangular, quadrilateral, or other geometrically related orientation as may be known in the art. Possible vacuum jet nozzle orientations are illustrated in FIGS. 10A-10D. A jet nozzle assembly could include an annular body having a top opening and a bottom opening, and jet nozzle(s) positioned on an interior wall of the annular body. The bottom mode also includes the forward thrust jet nozzle 254 that extends through a rear wall of a rear portion of the chassis 208. The forward thrust jet nozzle 254 is adapted for discharging a high velocity stream of water to propel the cleaner 200 in a generally forward path when the cleaner 200 is in its bottom mode. It is contemplated that in some embodiments more than one forward thrust jet nozzle 254 could be utilized.

Figure 8B:
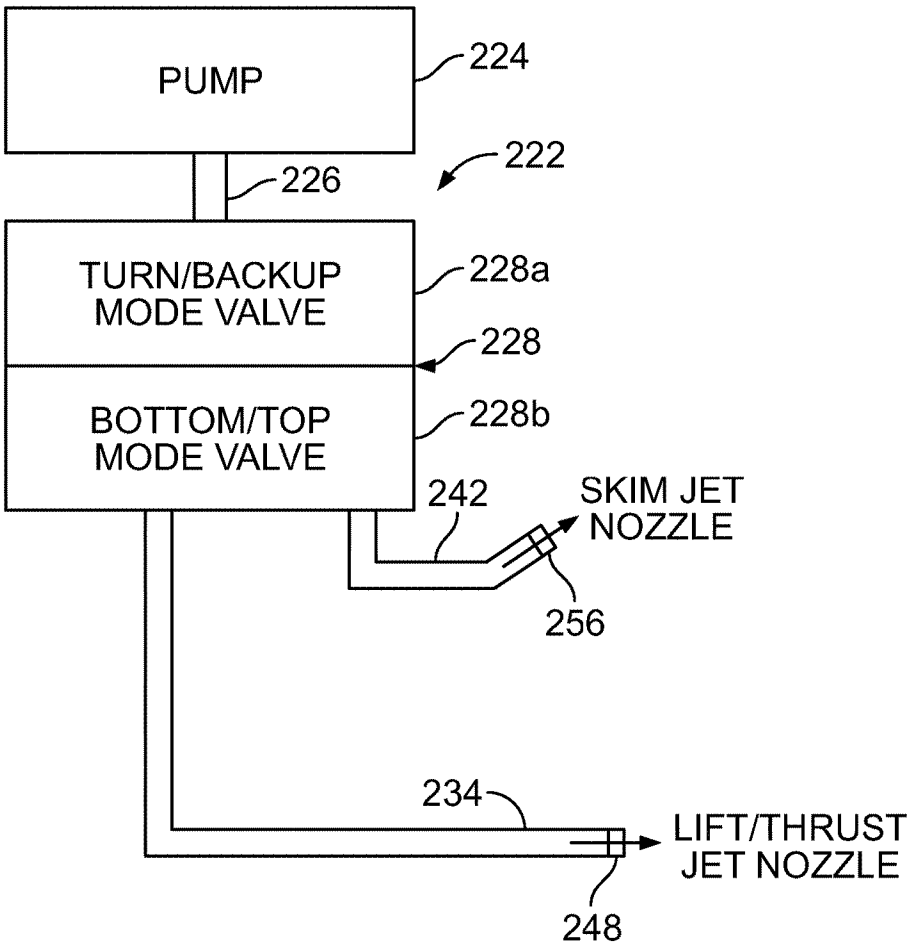
FIG. 8B is a block diagram depicting the water flow distribution of the top mode operation of the third embodiment of the present disclosure.

FIG. 8B is a block diagram depicting the water flow distribution of the top mode operation isolated from the other modes. Essentially, FIG. 8B illustrates the water distribution when the cleaner 200 is in top mode. The top mode comprises the lift/thrust jet hose 234, the skim jet hose 242, the lift/thrust jet nozzle 248, and the skim jet nozzle 256. The lift/thrust jet nozzle 248 extends through the rear wall of the rear portion of the chassis 208 and is adapted for discharging a high velocity stream of water to place the cleaner 200 proximate to the upper surface 112 of the pool water and propel the cleaner 200 along same when the cleaner 200 is in its top mode. It is contemplated that in some embodiments more than one lift/thrust jet nozzle 248 could be utilized. The chassis 208 is equipped with the decking 212 located at a frontal portion of the chassis 208 and projecting upwardly therefrom. The skim jet nozzle 256 is located on, and extends through, a wall of a decking 212, which is attached to the chassis 208. The skim jet nozzle 256 is adapted for discharging a high velocity stream of water so as to drive any debris floating on the upper surface 112 of the swimming pool 110 into a debris retention mechanism 258 connected to the cover 210. It is contemplated that in some embodiments the cleaner 200 could be equipped with debris retention jets for retaining any collected debris within the debris retention mechanism 258, and restricting the collected debris from exiting therefrom. The contemplated debris retention jets could be connected to the pumping system 222, and operated during any one of the various modes so that the debris is always retained in the debris retention mechanism 258.

Figure 8C:
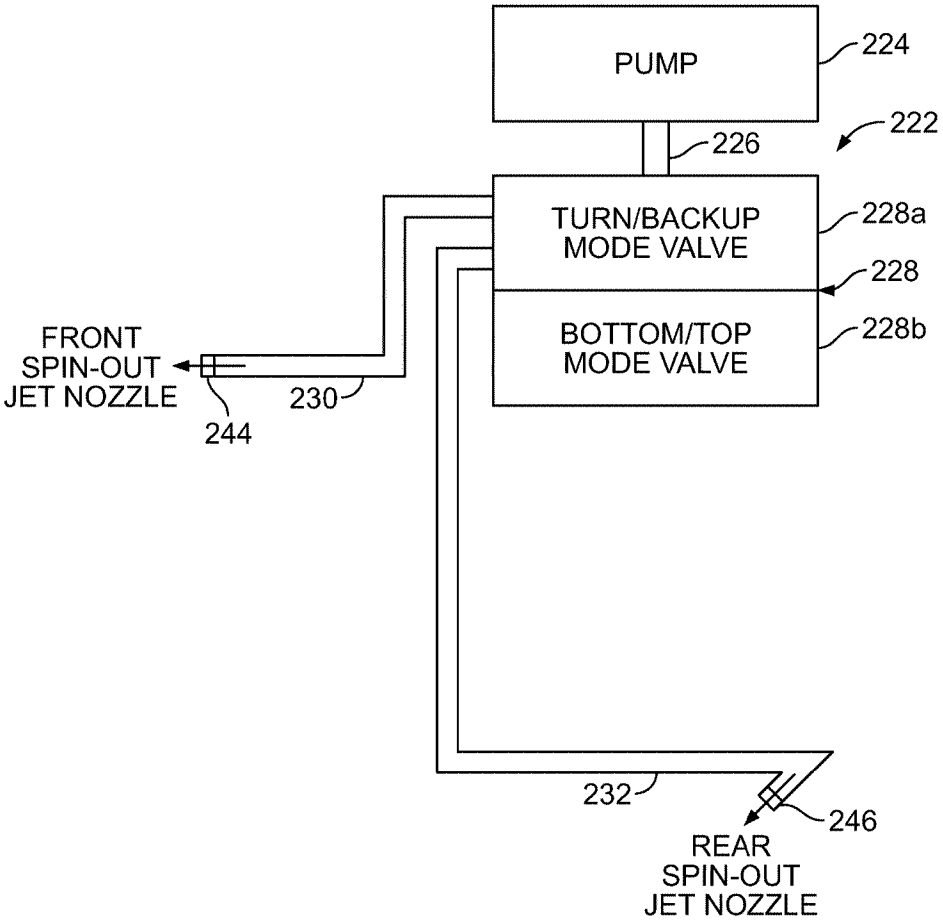
FIG. 8C is a block diagram depicting the water flow distribution of the turn/backup operation of the third embodiment of the present disclosure.

FIG. 8C is a block diagram depicting the water flow distribution of the turn/backup mode operation isolated from the other modes. Essentially, FIG. 8C illustrates the water distribution when the cleaner 200 is in turn/backup mode. The turn/backup mode comprises the front spin-out jet hose 230, the rear spin-out jet hose 232, the front spin-out jet nozzle 244, and the rear spin-out jet nozzle 246. The front spin-out jet nozzle 244 is mounted to a front wall section of the chassis 208, while the rear spin-out jet nozzle 246 is mounted to the rear wall of the chassis 208. More particularly, the front and rear spin-out jet nozzles 244, 246 are angled generally downwardly and are oriented at an angle relative to the longitudinal axis of the cleaner 200 so as to cause the cleaner 200 to spin in a predetermined direction (e.g., in a clockwise direction) and to thereby move away from its forward path in an arcuate sideward path, when the cleaner 200 is in the turn/backup mode. Because both the front and rear spin-out jet nozzles 244, 246 are directed downwardly, when the cleaner 200 is in the turn/backup mode, it is lifted vertically, facilitating the spinning or rotating motion of the cleaner 200. Alternatively, the front and rear spin-out nozzles 244, 246 can have different orientations, and can be positioned at different locations on the cleaner 200. For instance, the rear spin-out jet nozzle 246 can be positioned on the central axis of the rear wall of the chassis 208 and can be oriented substantially horizontally so as to produce a horizontally discharged spin-out jet directed toward a vertical side wall of the chassis 208, thereby further facilitating rotation of the cleaner 200. Alternatively, for instance, the front and rear spin-out jet nozzles 244, 246 could be oriented such that the cleaner 200 can move directly backwards and turn.

The cover 210 could include a deck and a pair of side walls projecting from the deck. The deck could include an access opening formed therein and an enclosure wall extending from the deck around the access opening. A door (e.g., a cap) could be pivotally mounted to the deck for closing the access opening. The cover 210 could also include a cross member spanning between the sidewalls. A hole is formed in the deck adjacent a rear end thereof. More particularly, the hole is sized and shaped so as to receive the upper end 220 of the suction tube 218. The upper end 220 of the section tube 218 is positioned flush with the deck of the cover 210. A rear debris opening is defined by the deck, the side walls, and the cross member. A slot is formed around the rear debris opening. Diverter wheels (not shown) could be rotatably mounted between the cover 210 and the chassis 208 along the outer most periphery of the chassis 208. The diverter wheels could be vertical axis wheels that are parallel to the bottom of a pool, and positioned on the cleaner 200 to deflect the cleaner 200 away from an obstruction or a wall of the swimming pool 110. Accordingly, the diverter wheels could extend beyond the outer most periphery of the chassis 208 so that they contact an obstruction or swimming pool wall instead of the chassis 208.

The debris retention mechanism 258 is removably attached to the cleaner 200 for receiving debris through the rear debris opening. The debris retention mechanism 258 can include a ring defining a mouth of the debris retention mechanism 258. The ring can be removably received in the slot and retained therein by a retainer member for attaching the debris retention mechanism 258 to the cleaner 200. The debris retention mechanism 258 can be a filter bag or a filter bucket.

A front center wheel 204 is mounted to a front portion of the chassis 208, while rear wheels 206 are mounted to the side walls of the chassis 208. The front and rear wheels 204, 206 are freely rotatable and are adapted to support the chassis 208 and hence the cleaner 200 on the interior wall 108 of the swimming pool 110. In other embodiments, the pool cleaner 200 can include two wheels rotatably positioned on the first side of the chassis 208 and two wheels rotatably positioned on the second side of the chassis 208 that can support the chassis 208 on a surface of a pool.

Referring again to FIG. 7, the power/control cable 106 is connected to the cleaner 200 (see FIG. 1) and provides power and commands from the transformer/control box 104, which includes a power supply 102 and a controller 174, to the pump 224 and the valve assembly 228. The transformer/control box 104 transforms a 120 VAC or 240 VAC (alternating current) input into a 24 VDC (direct current) output, respectively. One of ordinary skill in the art would understand that the transformer/control box 104 could transform the input voltage into any output voltage that may be known in the art, e.g., 12 VDC, 36 VDC, etc. The 24 VDC is communicated to the cleaner 200, wherein it powers a pump motor associated with the pump 224 and solenoids or servo motors associated with the turn/backup mode valve 228*a* and the bottom/top mode valve 228*b* of the valve assembly 228. The controller 174 can be provided as a PC board controller that can communicate with the pump 224 and the valve assembly 228. The controller 174 can include a control device, which could be any one of a screen and graphical user interface, mechanical switch, electronic switch, or program included in the controller, that allows a user to activate the cleaner 200 or quickly switch between the various modes when necessary. Specifically, when switching between modes, the controller 174 communicates with the valve assembly 228 to cause the turn/backup mode valve 228*a* and the bottom/top mode valve 228*b* to switch from one hose and nozzle grouping to another grouping, whereby flow is only allowed through the grouping that is activated.

Figure 9A:
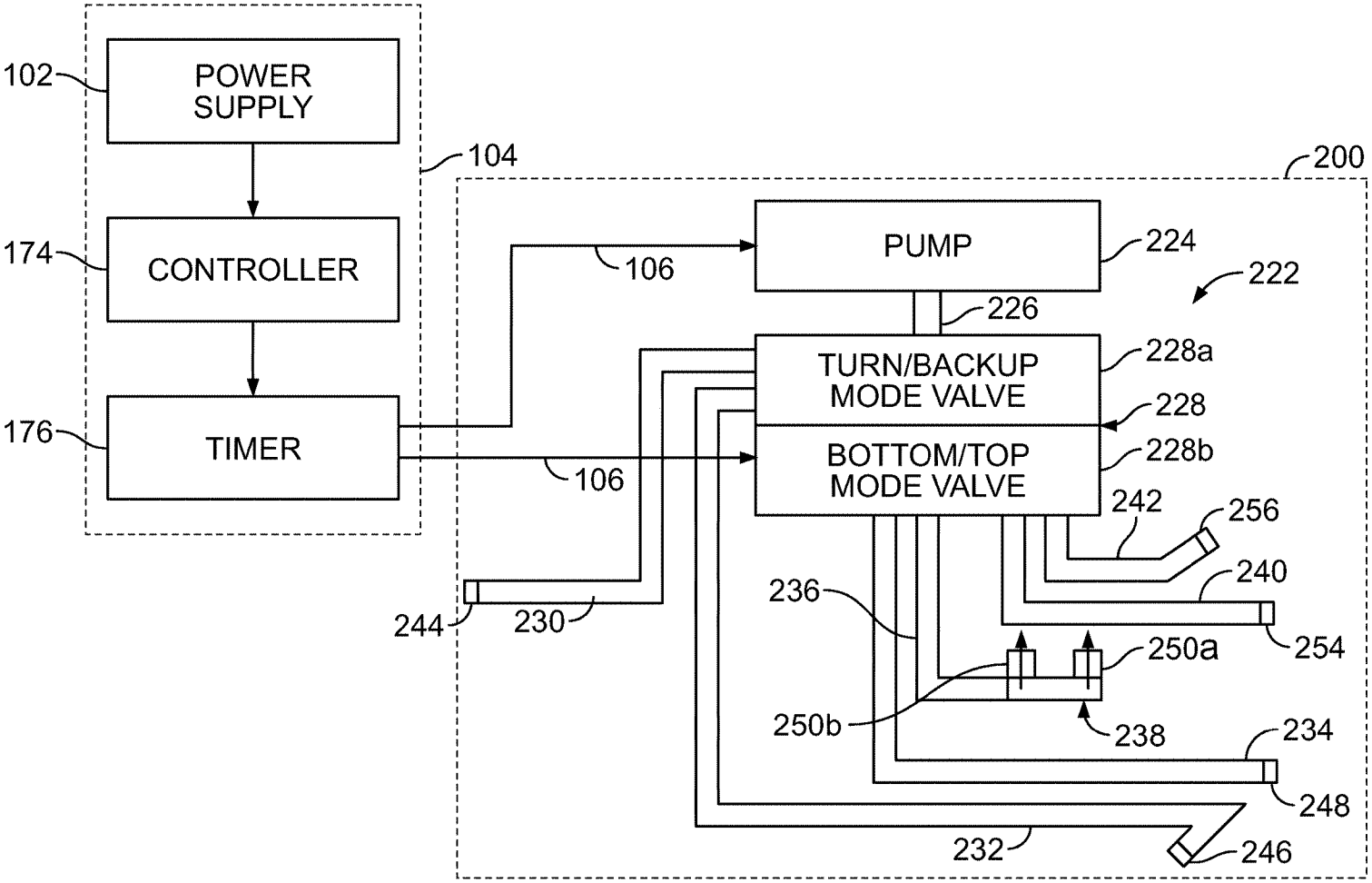
FIG. 9A is a block diagram depicting the electrical connections and water flow distribution of a fourth exemplary embodiment of the present disclosure.

In an alternate embodiment, the transformer/control box 104 could include a timer 176 that is in electrical communication with the power supply 102, the controller 174, the pump 224, and the valve assembly 228, as illustrated in FIG. 9A, which is a block diagram depicting the electrical connections and water flow distribution of a fourth exemplary embodiment of the present invention. The timer 176 allows the cleaner 200 to be programmed so that the controller 174 automatically switches the valve assembly 228 between the various modes without the need for user input. This is beneficial, for example, because a user might not be available to switch the cleaner 200 between the modes during the day, which often results in the cleaner 200 functioning for the day in bottom mode such that the upper surface 112 of the water accumulates floating debris. The timer 176 could either be factory set or can be adapted such that input devices connected to the controller 174, e.g., remote controls, home automation units, cell phones, graphical user interfaces, etc., allow a consumer to adjust the timing for the best coverage pattern for their pool size/shape. Alternatively, the timer 176 could be a mechanical timer.

Figure 9B:
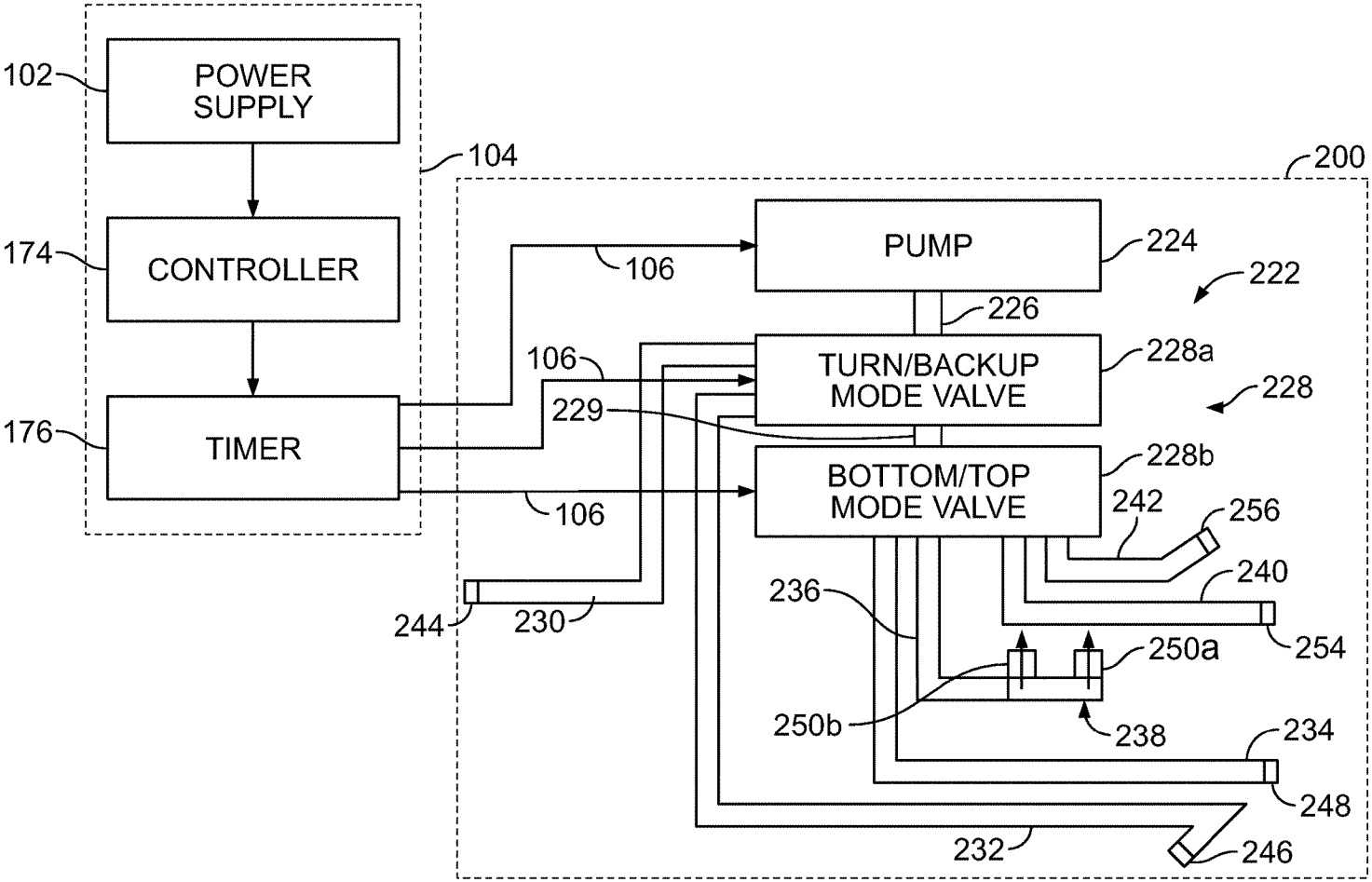
FIG. 9B is a block diagram depicting the electrical connections and water flow distribution of a fifth exemplary embodiment of the present disclosure.
Figure 10A:
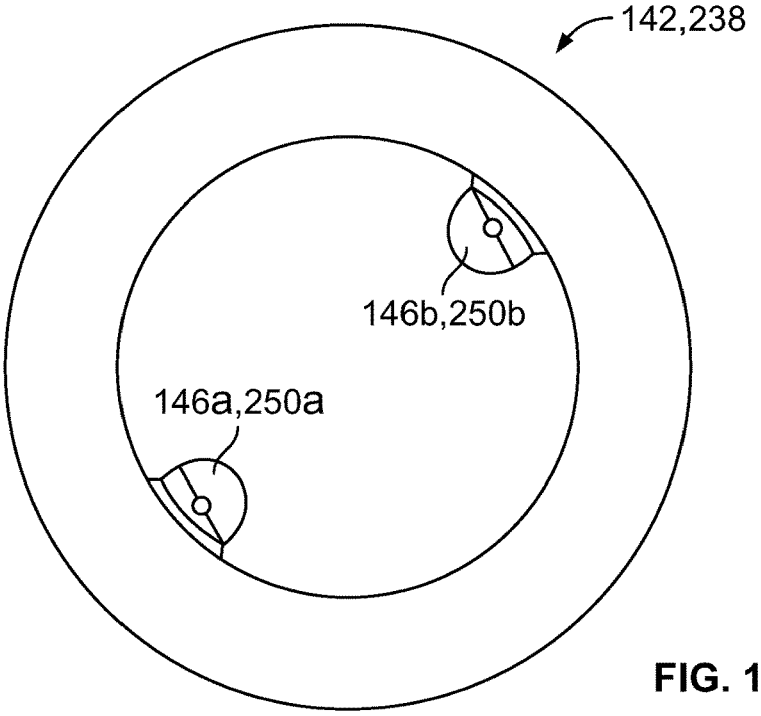
FIG. 10A is a top view of an exemplary vacuum jet nozzle manifold of the present disclosure having a single vacuum jet nozzle.
Figure 10B:
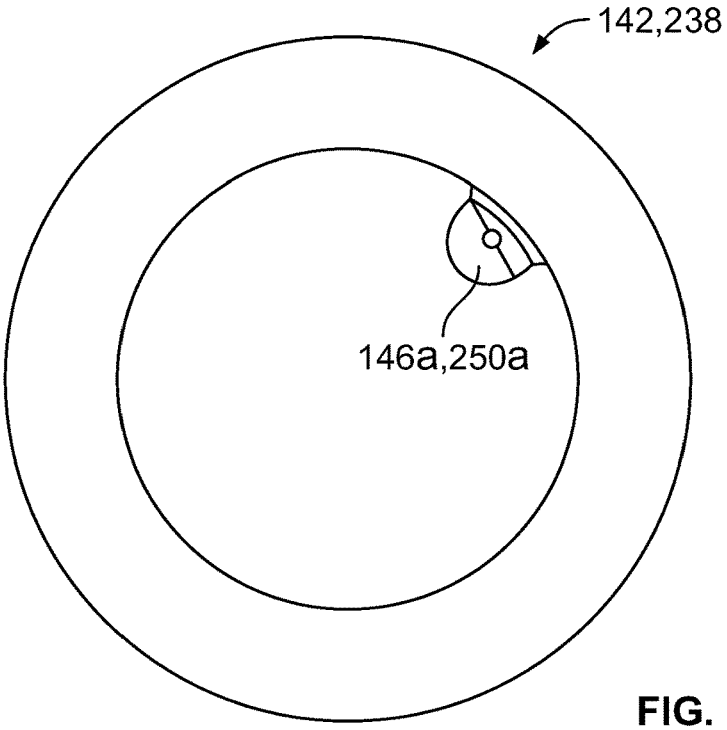
FIG. 10B is a top view of an exemplary vacuum jet nozzle manifold of the present disclosure having two vacuum jet nozzles.
Figure 10C:
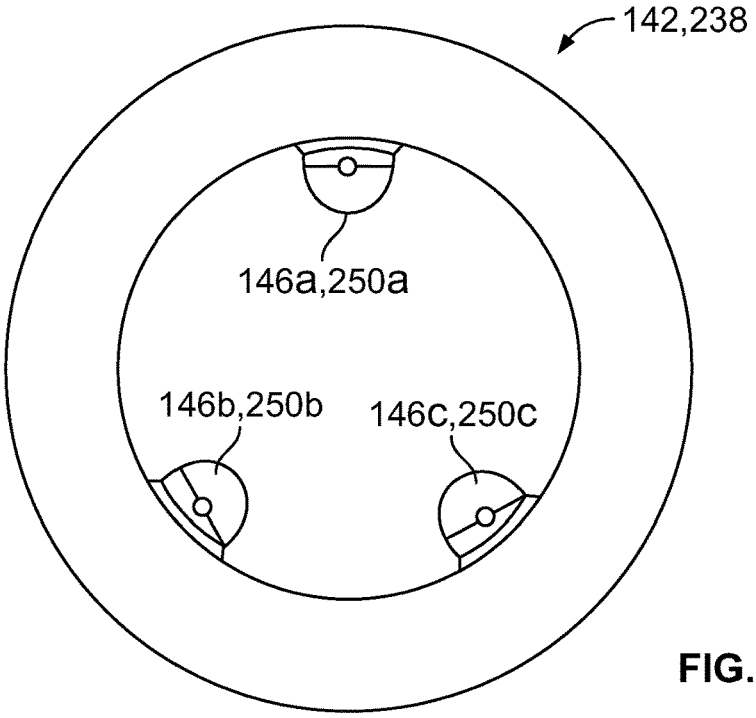
FIG. 10C is a top view of an exemplary vacuum jet nozzle manifold of the present disclosure having three vacuum jet nozzles.
Figure 10D:
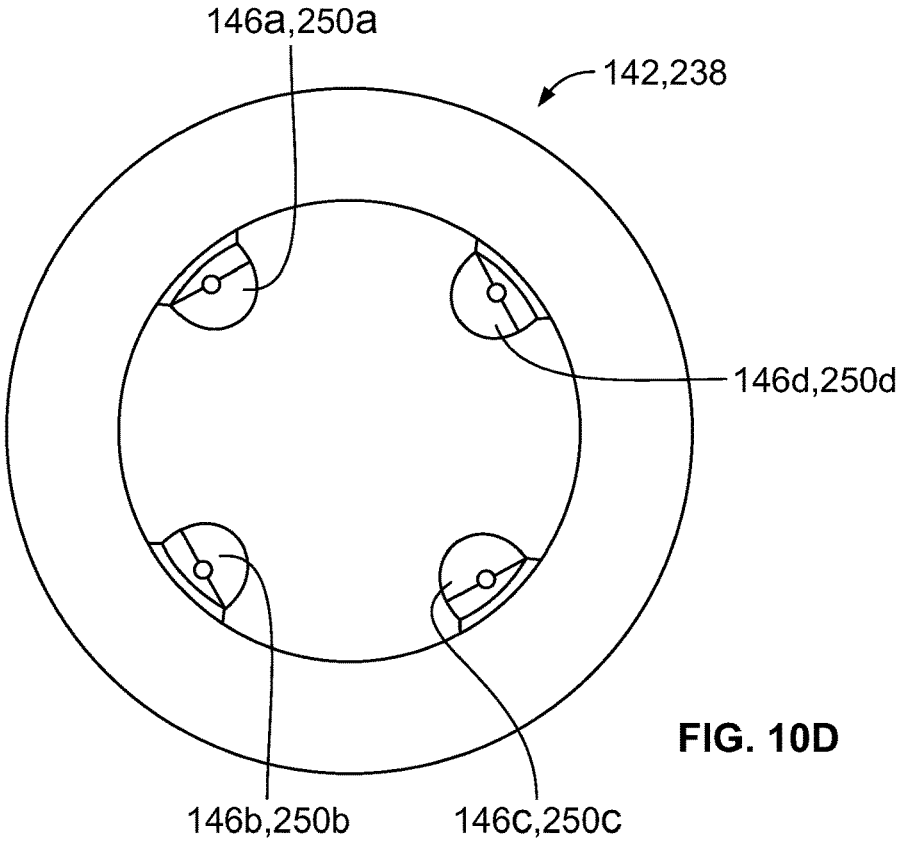
FIG. 10D is a top view of an exemplary vacuum jet nozzle manifold of the present disclosure having four vacuum jet nozzles.

FIG. 9B is a block diagram depicting the electrical connections and water flow distribution of a fifth exemplary embodiment of the present invention. The electrical connections and water flow distribution of FIG. 9B is similar in structure as described in connection with FIG. 9A. In this embodiment, a hose 229 is provided between the turn/backup mode valve 228*a* and the bottom/top mode valve 228*b*. Separate power/control cables 106 are in communication with the pump 224, the turn/backup mode valve 228*a*, and the bottom/top mode valve 228*b*.

The incorporation of pump(s) into the cleaner shown in FIGS. 2 and 6 differs from traditional robotic cleaners in that the water jet propulsion replaces the traditional drive tracks or wheels, and is also utilized to turn or change direction during operation. This incorporation reduces the complexity of the cleaner by reducing the amount of moving parts. Further, the incorporation of the pump(s) into the cleaner differs from traditional positive pressure pool cleaners by not requiring for the pool filtration system to be running to operate the cleaner.

FIGS. 11A-11D show an embodiment of a dual directional flow pump, e.g., pump 132, 150, 166, 224, that can be used with the above described cleaners 100, 200 of FIGS. 1-10. Particular reference is made to FIG. 11A, which is a top view of a centrifugal pump 132, 150, 166, 224, which for ease of reference will be referred to as pump 132. However, one of ordinary skill in the art would understand that the pump 132 could also be implemented as the pump 150, 166, 224. The pump 132 includes a body 260, a first outlet 262, a second outlet 264, and an inlet 266. A first flow path A exits the first outlet 262 and a second flow path B exits the second outlet 264.

Figure 11A:
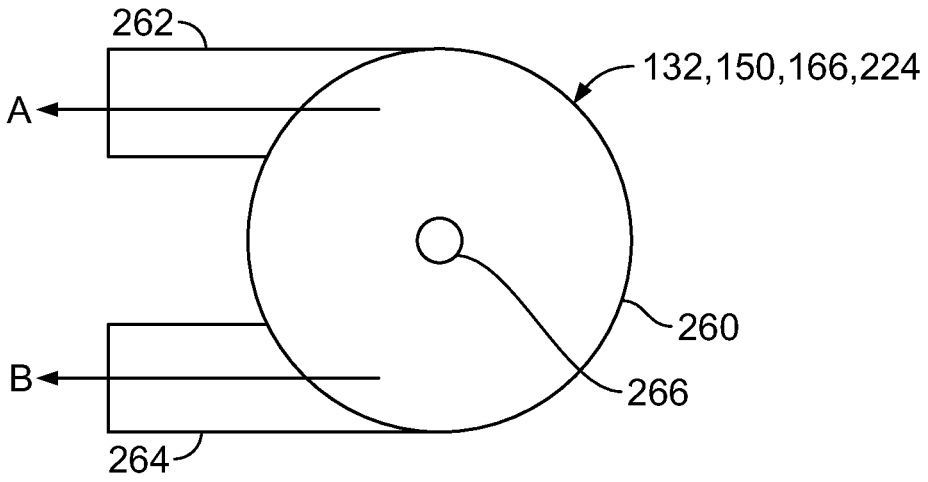
FIG. 11A is a top view of an exemplary dual directional flow pump of the present disclosure.
Figure 11B:
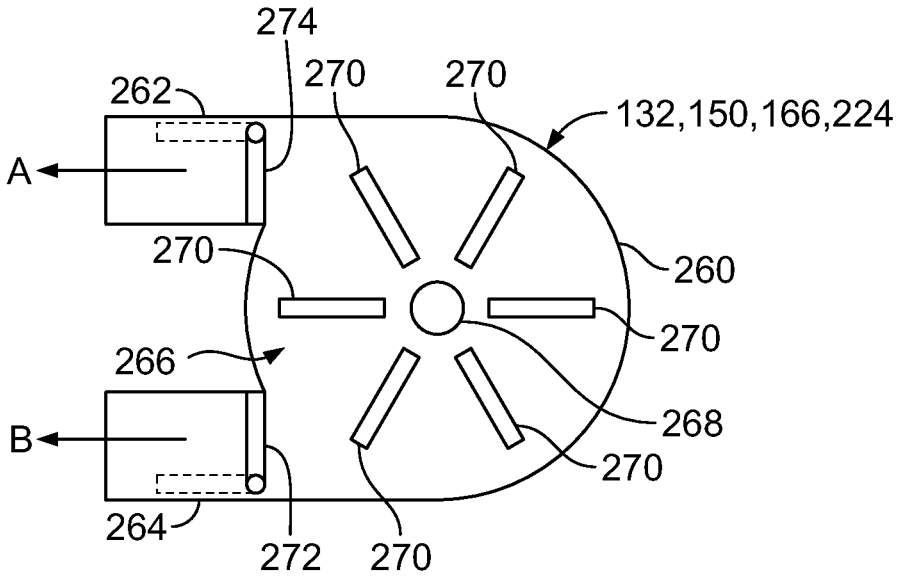
FIG. 11B is a top plan view of the dual directional flow pump of FIG. 11A.

FIG. 11B is a top plan view of the pump 132 of FIG. 11A. The pump body 260 defines an inner chamber 268 that includes a plurality of vanes 270 that form an impeller and are rotatable about the inlet 266. A first spring-loaded flap valve 274 is provided adjacent the first outlet 262, and a second spring-loaded flap valve 272 is provided adjacent the second outlet 264. Water is provided to the pump 132 through the inlet 266, where it enters the body 260. The vanes 270 accelerate the water radially and force the water out of the first and second outlets 262, 264 depending on rotational direction of the vanes 270. Specifically, when the vanes 270 rotate clockwise, the vanes 270 pressurize and accelerate the water such that the water forces the second spring-loaded flap valve 272 open, allowing the pressurized water to exit the pump 132 through the second outlet 264. The first spring-loaded flap valve 274 remains closed due to the direction of flow exiting the pump 132. Alternatively, when the vanes 270 rotate counter-clockwise, the vanes 270 pressurize and accelerate the water such that the water forces the first spring-loaded flap valve 274 open, allowing the pressurized water to exit the pump 132 through the first outlet 262. The second spring-loaded flap valve 272 remains closed due to the direction of flow exiting the pump 132. The dual direction flow of the pump 132 can be achieved, for example, by providing a motor (not shown) associated with the pump 132 with an energy having a positive polarity to achieve clockwise rotation, and with an energy have a negative polarity to change the rotation to counter-clockwise.

Figure 11C:
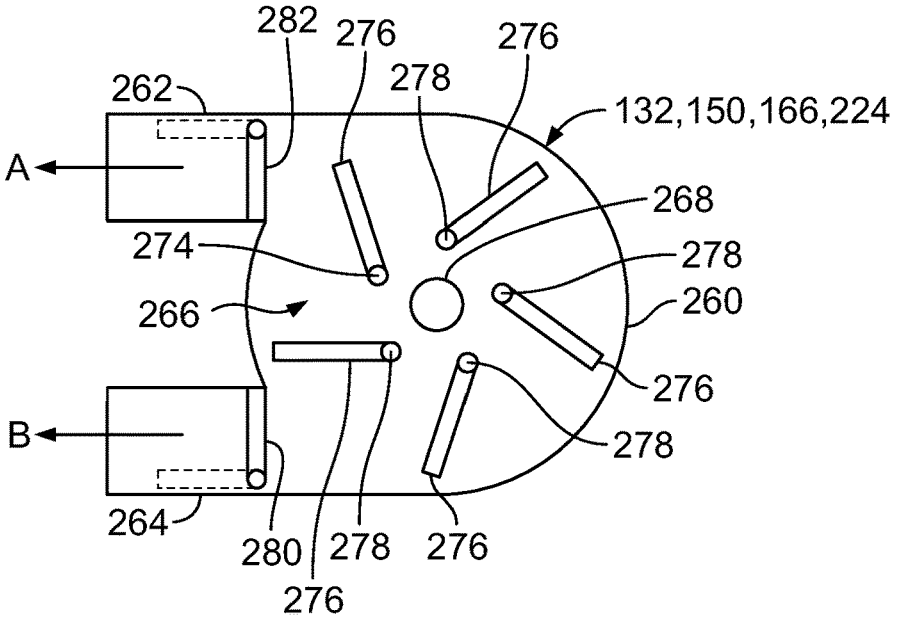
FIG. 11C is a top plan view of another dual directional flow pump of the present disclosure in a first configuration.
Figure 11D:
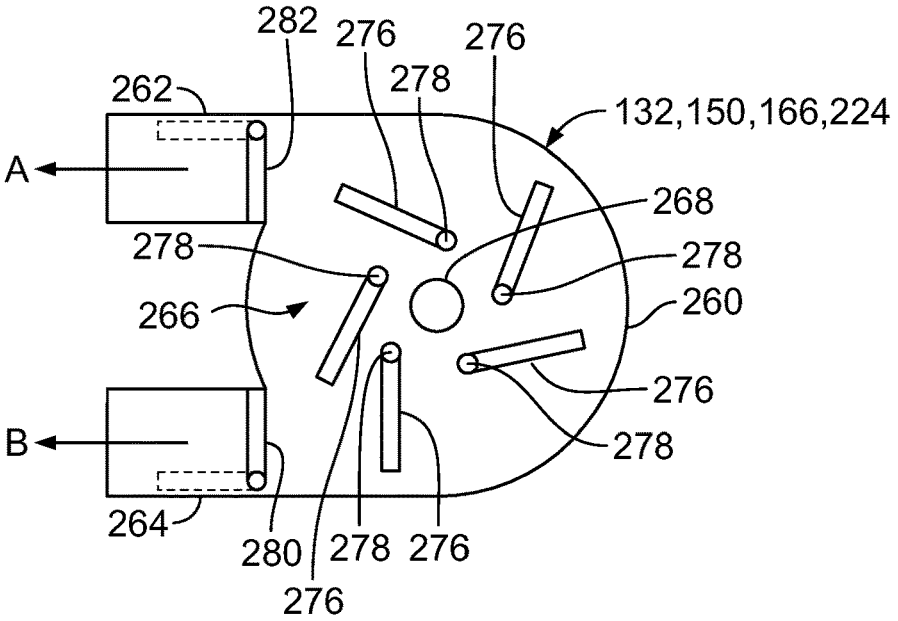
FIG. 11D is a top plan view of the dual directional flow pump of FIG. 11C in a second configuration.

FIGS. 11C-11D show another embodiment of the dual directional flow centrifugal pump 132 of FIGS. 11A-11B. Particular reference is made to FIG. 11C, which is a top plan view of the dual directional flow centrifugal pump 132. In the embodiment shown in FIG. 11C, the pump 132 can include a plurality of vanes 276 that are each rotatable about an axis 278 (e.g., a pin). The vanes 276 may be rotatable about the axis 278 a set amount that is relative to a "radial position," e.g., the position of the vanes 270 shown in FIGS. 11A-11B. For example, the vanes 276 could rotate about the axis 278 between −15° and +15° from the "radial position."

Each of the vanes 276 could include a stopper (not shown) the restricts the vane 276 from rotating further than −15° or +15°. According, the vanes 276 are rotatable about the axis 278, and the vanes 276 and axis 278 combination are rotatable about the inlet 266. The orientation of the vanes 276 about the axis 278 will be determined by the rotational direction of the vanes 276 about the inlet 266.

FIG. 11C shows the vanes 276 rotated a positive amount, e.g., clockwise, from the "radial position" about the axis 278. This position occurs when the vanes 276 rotate counter-clockwise about the inlet 266. Accordingly, when the vanes 276 rotate counter-clockwise about the inlet 266, the rotational force will cause the vanes 276 to rotate clockwise about the axis 278, and the vanes 276 will pressurize and accelerate water that is in the body 260. The pressurized water forces a first spring-loaded flap valve 282 open, allowing the pressurized water to exit the pump 132 through the first outlet 262.

FIG. 11D shows the vanes 276 rotated a negative amount, e.g., counter-clockwise, from the "radial position" about the axis 278. This position occurs when the vanes 276 rotate clockwise about the inlet 266. Accordingly, when the vanes 276 rotate clockwise about the inlet 266, the rotational force will cause the vanes 276 to rotate counter-clockwise about the axis 278, and the vanes 276 will pressurize and accelerate water that is in the body 260. The pressurized water forces a second spring-loaded flap valve 280 open, allowing the pressurized water to exit the pump 132 through the second outlet 264.

Accordingly, the pump 132 can be positioned in a system that utilizes alternating directional flow. For example, the pump 132 could be positioned between the forward thrust jet nozzle 144 and the front spin-out jet nozzle 170 of FIG. 2, such that the first pump outlet 262 is connected with the forward thrust jet nozzle 144 and the second pump outlet 264 is connected with the front spin-out jet nozzle 170. In such an arrangement, the pump 132 can alternate between providing the forward thrust jet nozzle 144 and the front spin-out jet nozzle 170 with pressurized water by switching rotational direction of the pump vanes 270. In such circumstances, the control instructions provided to the pump can include an off instruction, a forward (and/or clockwise) direction instruction, and/or a reverse (and/or counter-clockwise) direction instruction. It is further contemplated that the motor of the pump can be provided with a variable frequency to control the rotational speed of the motor to influence the magnitude of the propulsive force of the water flow through a nozzle.

Figure 11E:
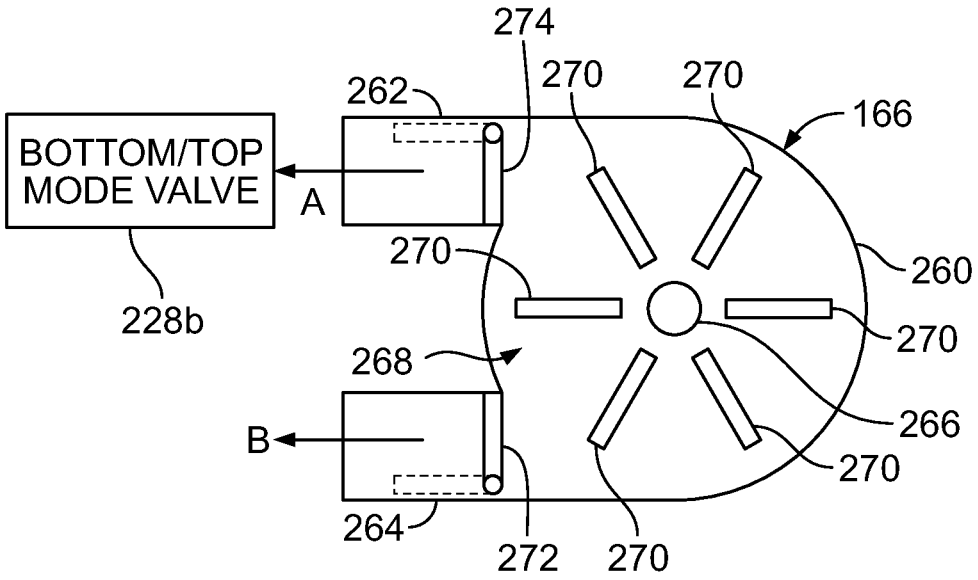
FIG. 11E is a top plan view of an another dual directional flow pump of an exemplary embodiment of the present disclosure.

FIG. 11E shows an embodiment of the dual directional flow pump 166 that can be used with the above described cleaner 200 of FIGS. 6-10. In this embodiment, the turn/backup pump 166 replaces the turn/backup mode valve 228*a*. In particular, when the vanes 270 rotate clockwise, the vanes 270 pressurize and accelerate the water such that the water forces the second spring-loaded flap valve 272 open, allowing the pressurized water to exit the pump 166 through the second outlet 264, depicted by second flow path B. In the second flow path B, the water flow is directed to the front spin-out jet hose 230, the rear spin-out jet hose 232, the front spin-out jet nozzle 244, and the rear spin-out jet nozzle 246, and does not flow to the bottom/top mode valve 228*b*. The first spring-loaded flap valve 274 remains closed due to the direction of flow exiting the pump 166. Alternatively, when the vanes 270 rotate counter-clockwise, the vanes 270 pressurize and accelerate the water such that the water forces the first spring-loaded flap valve 274 open, allowing the pressurized water to exit the pump 166 through the first outlet 262, depicted by second flow path A. In the second flow path A, the water flow is directed to the bottom/top mode valve 228*b*. The second spring-loaded flap valve 272 remains closed due to the direction of flow exiting the pump 166.

Figure 12:
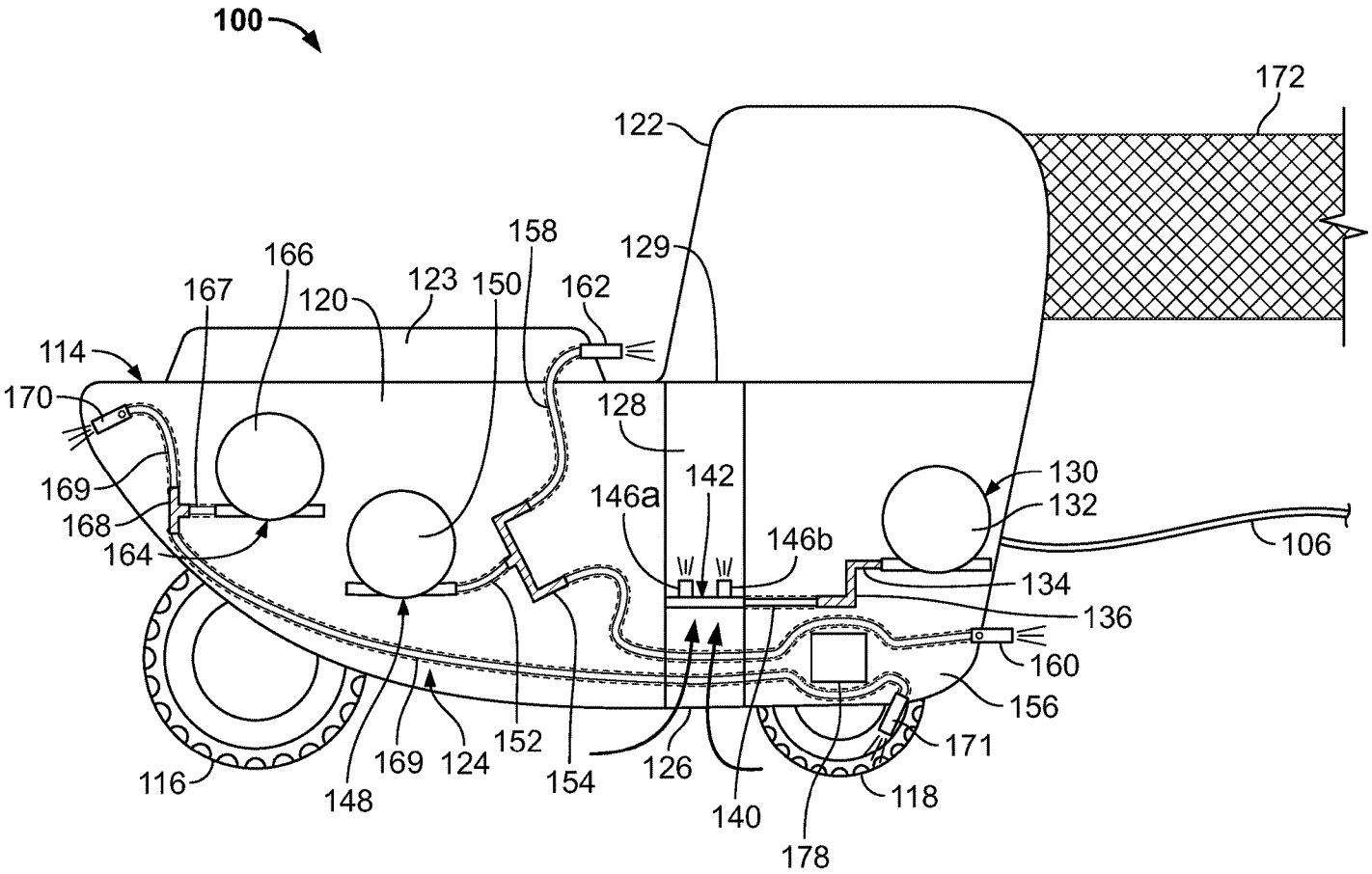
FIG. 12 is a side elevational view of the pool cleaner according to a sixth exemplary embodiment of the present disclosure.

FIG. 12 is a side elevational view of the pool cleaner according to a sixth exemplary embodiment of the present disclosure. The cleaner of FIG. 12 is similar in structure as described in connection with FIG. 2. In this embodiment, the suction tube 128 is at an angle that is perpendicular with respect to the interior wall 108 of the swimming pool 100 (e.g., perpendicular with respect to a cleaning surface over which the cleaner is traveling). The bottom mode pumping system 130 includes only the vacuum jet nozzle manifold 142, and does not include the forward thrust jet nozzle 144. In this embodiment, traditional wheels are utilized to propel the cleaner rather than the water jet propulsion when the cleaner is in the bottom mode. In particular, the cleaner 100, when in the bottom mode, is propelled by the rear wheels 118, which can be powered by an electric motor 178. A drive transfer system (not shown) could be used to transfer power from the motor 178 to the rear wheels 118. The drive transfer system could be used to steer the cleaner in left, right, forward, and/or backward directions.

Although the foregoing disclosure was discussed in connection with pools and spas, it is to be understood that the systems and methods disclosed herein could be utilized in connection with any body of water where sanitization is necessary, e.g., fountains, ponds, water features, etc.

It will be understood that the embodiments of the present invention described herein are merely exemplary and that a person skilled in the art may make many variations and modifications without departing from the spirit and the scope of the invention.

What is claimed is:

1. A pool cleaner, comprising:

a housing having a front end, a rear end, a first side, a second side, a bottom wall, and a top wall;

a first aperture extending through the bottom wall;

a second aperture extending through the top wall;

a tube extending through the housing and between the first aperture and the second aperture, the tube being in fluidic communication with the first aperture and the second aperture;

a debris retention mechanism connected to the housing;

a first pump and a second pump positioned within the housing;

the first pump in fluidic communication with at least one vacuum jet nozzle positioned to discharge water through the tube;

the second pump in fluidic communication with: (1) a lift/thrust jet nozzle positioned generally at a bottom of the rear end, and (2) a skim jet nozzle positioned to discharge water toward the debris retention mechanism;

a power supply external to the housing, the power supply providing power to the first pump and the second pump; and a controller connected to the first pump and the second pump, the controller providing control instructions to the first pump and the second pump to switch the pool cleaner between a bottom mode and a top mode;

wherein when the pool cleaner is in the bottom mode, the first pump is energized and pumps fluid to the at least one vacuum jet nozzle, the at least one vacuum jet nozzle discharging water through the tube; and wherein when the pool cleaner is in the top mode, the second pump is energized and pumps fluid to the lift/thrust jet nozzle and the skim jet nozzle, the lift/thrust jet nozzle propelling the pool cleaner in a generally forwardly and upwardly direction and the skim jet nozzle discharging water into the debris retention mechanism.

2. The pool cleaner of claim 1, further comprising a third pump positioned within the housing, the third pump in fluidic communication with at least one spinout jet nozzle positioned on the housing to generally offset a regular course of travel of the pool cleaner.

3. The pool cleaner of claim 2, wherein the power supply provides power to the third pump and the controller is connected to the third pump, the controller providing control instructions to the first pump, the second pump, and the third pump to switch the pool cleaner between the bottom mode, the top mode, and a spinout mode.

4. The pool cleaner of claim 3, wherein when the pool cleaner is in the spinout mode, the third pump is energized and pumps fluid to the at least one spinout jet nozzle, the at least one spinout jet nozzle discharging water to generally offset the regular course of travel of the pool cleaner.

5. The pool cleaner of claim 1, wherein the first pump is in fluidic communication with a forward thrust jet nozzle, the forward thrust jet nozzle propelling the pool cleaner in a generally forward direction when the pool cleaner is in the bottom mode.

6. The pool cleaner of claim 1, further comprising a wheel and a motor operatively connected to the wheel to propel the pool cleaner in a generally forward direction when the pool cleaner is in the bottom mode.

7. The pool cleaner of claim 1, wherein the tube is perpendicular with respect to a cleaning surface over which the pool cleaner is traveling.

8. The pool cleaner of claim 3, further comprising a timer mechanism in communication with the first pump, the second pump, and the third pump, wherein the timer mechanism automatically switches power between the first pump, the second pump, and the third pump based on a timed schedule.

9. The pool cleaner of claim 8, wherein the timer mechanism includes a user-definable program for switching power between the first pump, the second pump, and the third pump.

10. The pool cleaner of claim 1, further comprising a vacuum jet nozzle manifold containing the at least one vacuum jet nozzle and positioned within the tube;

wherein the vacuum jet nozzle manifold receives fluid from the first pump and directs the fluid to the at least one vacuum jet nozzle.

11. The pool cleaner of claim 10, wherein the at least one vacuum jet nozzle is positioned to discharge fluid in a helical path into the tube.

12. A pool cleaner, comprising:

a housing having a front end, a rear end, a first side, a second side, a bottom wall, and a top wall;

a first aperture extending through the bottom wall;

a second aperture extending through the top wall;

a tube extending through the housing and between the first aperture and the second aperture, the tube being in fluidic communication with the first aperture and the second aperture;

a debris retention mechanism connectable to the housing;

a pump positioned within the housing;

a first valve in fluidic communication with a forward thrust jet nozzle positioned generally at a top of the rear end, at least one vacuum jet nozzle positioned to discharge water through the tube, a lift/thrust jet nozzle generally positioned at a bottom of the rear end, and a skim jet nozzle positioned to discharge water toward the debris retention mechanism;

a power supply external to the housing, the power supply providing power to the pump; and a controller in communication with the pump and the first valve, the controller providing control instructions to the pump and the first valve, to switch the first valve between a first position and a second position, wherein when the first valve is in the first position, the first valve provides pressurized fluid to the forward thrust jet nozzle and the at least one vacuum jet nozzle, the forward thrust jet nozzle propelling the pool cleaner in a generally forward direction and the at least one vacuum jet nozzle discharging water through the tube and into the debris retention mechanism; and wherein when the first valve is in the second position, the first valve provides pressurized fluid to the lift/thrust jet nozzle and the skim jet nozzle, the lift/thrust jet nozzle propelling the pool cleaner in a generally forward and upwardly direction and the skim jet nozzle discharging water into the debris retention mechanism.

13. The pool cleaner of claim 12, further comprising a second valve receiving fluid from the pump, the first valve receiving fluid from the second valve, the second valve in fluidic communication with at least one spinout jet nozzle positioned on the housing to generally offset a regular course of travel of the pool cleaner, the controller providing control instructions to the second valve to switch the second valve between a third position and a fourth position.

14. The pool cleaner of claim 13, wherein when the second valve is in the third position, the second valve provides pressurized fluid to the at least one spinout jet nozzle, the at least one spinout jet nozzle discharging fluid to generally offset the regular course of travel of the pool cleaner, and wherein when the second valve is in the fourth position, the second valve provides pressurized fluid to the first valve.

15. The pool cleaner of claim 14, wherein the first valve is positioned adjacent to the second valve.

16. The pool cleaner of claim 14, further comprising a hose separating the first valve and the second valve.

17. The pool cleaner of claim 12, wherein the pump is in fluidic communication with at least one spinout jet nozzle positioned on the housing to generally offset a regular course of travel of the pool cleaner.

18. The pool cleaner of claim 12, wherein the pump is operable to provide pressurized fluid to the first valve.

19. The pool cleaner of claim 14, comprising a timer mechanism in communication with the pump, the first valve, and the second valve, wherein the timer mechanism automatically switches the first valve between the first position and the second position and the second valve between the third position and the fourth position based on a timed schedule.

20. The pool cleaner of claim 19, wherein the timer mechanism includes a user-definable program for switching the first valve between the first position and the second position and the second valve between the third position and the fourth position.

21. The pool cleaner of claim 20, further comprising a front wheel rotatably positioned on the front end of the housing, a first rear wheel rotatably positioned on the first side of the housing, and a second rear wheel rotatably positioned on the second side of the housing;

wherein the front wheel, the first rear wheel, and the second rear wheel support the housing on a surface of a pool.

22. The pool cleaner of claim 14, comprising a vacuum jet nozzle manifold containing the at least one vacuum jet nozzle and positioned within the tube;

wherein the vacuum jet nozzle manifold receives fluid from the second valve and directs the fluid to the at least one vacuum jet nozzle.

23. The pool cleaner of claim 22, wherein the at least one vacuum jet nozzle is positioned to discharge fluid in a helical path into the tube.

24. The pool cleaner of claim 13, wherein the first and second valves are solenoid valves.

25. A pool cleaner, comprising:

a housing defining an internal chamber;

a debris retention mechanism;

a first pump and a second pump positioned within the internal chamber and receiving power from a power supply external from the pool cleaner; and a controller connected to the first pump and the second pump, wherein the first pump provides pressurized water to at least one vacuum jet nozzle for removing debris from a pool surface and propelling the debris into the debris retention mechanism; and wherein the second pump provides pressurized water to: (1) at least one lift/thrust jet nozzle for propelling the pool cleaner to a pool surface and providing forward propulsion of the pool cleaner, and (2) a skim jet nozzle for discharging water into the debris retention mechanism.

26. The pool cleaner of claim 25, further comprising a third pump positioned within the housing, the third pump in fluidic communication with at least one spinout jet nozzle positioned on the housing to generally offset a regular course of travel of the pool cleaner.

27. The pool cleaner of claim 26, wherein the power supply provides power to the third pump, and the controller is connected to the third pump.

28. The pool cleaner of claim 25, wherein the first pump is in fluidic communication with a forward thrust jet nozzle, the forward thrust jet nozzle propelling the pool cleaner in a generally forward direction.

29. The pool cleaner of claim 25, further comprising a wheel and a motor operatively connected to the wheel to propel the pool cleaner in a generally forward direction.

30. The pool cleaner of claim 27, comprising a timer mechanism in communication with the first pump, the second pump, and the third pump, wherein the timer mechanism automatically switches power between the first pump, the second pump, and the third pump based on a timed schedule.

31. The pool cleaner of claim 30, wherein the timer mechanism includes a user definable program for switching between the first, second, and third pumps.

32. The pool cleaner of claim 25, further comprising a front wheel rotatably positioned on a front end of the housing, a first rear wheel rotatably positioned on a first side of the housing, and a second rear wheel rotatably positioned on a second side of the housing;

wherein the front wheel, the first rear wheel, and the second rear wheel support the housing on a surface of a pool.

33. The pool cleaner of claim 25, further comprising:

a first aperture extending through a first wall of the housing;

a second aperture extending through a second wall of the housing; and a tube extending through the housing and between the first aperture and the second aperture.

34. The pool cleaner of claim 33, further comprising a vacuum jet nozzle manifold containing the at least one vacuum jet nozzle and positioned within the tube;

wherein the vacuum jet nozzle manifold receives fluid from the first pump and directs the fluid to the at least one vacuum jet nozzle.

35. A pool cleaner, comprising:

a housing defining an internal chamber;

a debris retention mechanism;

a pump positioned within the internal chamber;

a first valve positioned within the internal chamber;

a second valve positioned within the internal chamber;

a controller in communication with the pump, the first valve, and the second valve, the controller switching the first valve between a first position and a second position, and the second valve between a third position and a fourth position; and a power supply providing power to the pump, the controller, the first valve, and the second valve, wherein when the first valve is in the first position, the first valve provides pressurized fluid to at least one spinout jet nozzle for discharging fluid to offset a general path of the pool cleaner;

wherein when the first valve is in the second position, the first valve provides pressurized fluid to the second valve;

wherein when the first valve is in the second position and the second valve is in the third position, the second valve provides pressurized fluid to: (1) at least one vacuum jet nozzle for removing debris from a pool surface and propelling the debris into the debris retention mechanism, and (2) at least one forward thrust jet nozzle for providing forward propulsion of the pool cleaner; and wherein when the first valve is in the second position and the second valve is in the fourth position, the second valve provides pressurized fluid to: (1) at least one lift/thrust jet nozzle for propelling the pool cleaner to a pool surface and providing forward propulsion of the pool cleaner, and (2) a skim jet nozzle for discharging water into the debris retention mechanism.

36. The pool cleaner of claim 35, comprising a timer mechanism in communication with the pump, the first valve, and the second valve, wherein the timer mechanism automatically switches the first valve between the first position and the second position and the second valve between the third position and the fourth position based on a timed schedule.

37. The pool cleaner of claim 36, wherein the timer mechanism further includes a user definable program for switching the first valve between the first position and the second position and the second valve between the third position and the fourth position.

* * * * *